US012357111B2

(12) United States Patent
Conway et al.

(10) Patent No.: US 12,357,111 B2
(45) Date of Patent: Jul. 15, 2025

(54) CARTRIDGE CARRIERS AND DISPENSING APPARATUSES FOR BULK ITEM STORAGE SYSTEMS

(71) Applicant: Purcell Industries Inc., Santa Cruz, CA (US)

(72) Inventors: David Conway, Santa Cruz, CA (US); Russell Conway, Santa Cruz, CA (US); Eric Bodnar, Santa Cruz, CA (US); Matias Botero, Paris (FR)

(73) Assignee: Purcell Industries Inc., Santa Cruz, CA (US)

( * ) Notice: Subject to any disclaimer, the term of this patent is extended or adjusted under 35 U.S.C. 154(b) by 0 days.

(21) Appl. No.: 18/880,671

(22) PCT Filed: Sep. 7, 2024

(86) PCT No.: PCT/US2024/045742

§ 371 (c)(1),
(2) Date: Jan. 2, 2025

(87) PCT Pub. No.: WO2025/054565

PCT Pub. Date: Mar. 13, 2025

(65) Prior Publication Data

US 2025/0169622 A1 May 29, 2025

Related U.S. Application Data

(60) Provisional application No. 63/537,135, filed on Sep. 7, 2023.

(51) Int. Cl.
*A47F 1/03* (2006.01)

(52) U.S. Cl.
CPC ..... *A47F 1/03* (2013.01)

(58) Field of Classification Search
CPC . A47F 1/03; A47F 1/035; B65B 37/04; A47G 19/34; G01F 11/24
See application file for complete search history.

(56) References Cited

U.S. PATENT DOCUMENTS 4,619,379 A 10/1986 Biehl
6,182,864 B1 2/2001 Elmore
(Continued)

OTHER PUBLICATIONS

Search Report and Written Opinion of the International Searching Authority for PCT/US2024/045742, mailed Dec. 16, 2024, pp. 1-6.

*Primary Examiner* — Vishal Pancholi
(74) *Attorney, Agent, or Firm* — Lempia Summerfield Katz

(57) ABSTRACT

Dispensing apparatuses, systems, and methods are provided. The dispensing apparatus includes a main body configured to receive a bulk product into a main body volume via an open top. The dispensing apparatus further includes a drop valve positioned below and connected to the main body at a pivot point, wherein the drop valve is configured to move about the pivot point between a closed position and an open position. In the closed position, the dispensing apparatus includes a securing force configured to secure the bulk product from exiting the dispensing apparatus. In the open position, the drop valve is configured to provide an opening for the bulk product to exit the dispensing apparatus via gravity. The drop valve is configured to move about the pivot point between the closed position and the open position via a dispensing force applied to the drop valve that is greater than the securing force.

21 Claims, 21 Drawing Sheets

(56) References Cited

U.S. PATENT DOCUMENTS

| | | | | |
|---|---|---|---|---|
| 7,178,697 | B2 * | 2/2007 | Brundick | A47F 1/03 222/243 |
| 10,945,537 | B2 * | 3/2021 | Brundick | A47F 1/03 |
| 2014/0190987 | A1 * | 7/2014 | Brundick | A47F 1/08 222/566 |
| 2015/0276453 | A1 | 10/2015 | Rusch | |
| 2020/0405075 | A1 * | 12/2020 | Mackay | A47F 10/02 |

* cited by examiner

Nesting for shipping efficiency

CARTRIDGE CARRIERS AND DISPENSING APPARATUSES FOR BULK ITEM STORAGE SYSTEMS

This application is a § 371 nationalization of PCT Application Serial No. PCT/US2024/045742, filed Sep. 7, 2024, designating the United States, which claims the benefit of U.S. Provisional Patent Application No. 63/537,135, filed Sep. 7, 2023, which are hereby incorporated by reference in their entireties.

FIELD

The following disclosure relates to cartridge carriers and dispensing apparatuses for storage systems configured to dispense bulk product/items (e.g., bulk food).

BACKGROUND

With both consumers and retailers seeking to be environmentally friendly, bulk food options (e.g., unpackaged foods in bins) are an emerging consumer trend in the grocery industry. Some advantages of bulk food grocery options to consumers include the ability to precisely purchase a given amount of food and better pricing (i.e., bulk foods may be 25% less expensive on average than packaged counterparts). Furthermore, advantages of bulk food grocery options to retailers may include higher stocking density and higher profit (i.e., bulk foods may carry up to 50% profit margin).

However, current drawbacks to bulk food options may include many time consuming and labor consuming tasks. These include removing and refilling empty bulk containers, regular cleaning of bulk containers to maintain food safety and avoid cross-contamination, and emptying and replacing poor selling or expired food items, for example.

What is needed, therefore, is a device or system that modernizes retail bulk grocery in a unique way that technologically remedies these issues such that an operator may efficiently replenish and replace bulk food items while maintaining high levels of cleanliness and food safety.

BRIEF SUMMARY

The disclosure relates to cartridge carriers and dispensing apparatuses for storage systems configured to dispense bulk products/items (e.g., bulk food).

In an embodiment, a dispensing apparatus is provided. The dispensing apparatus includes a main body having four side surfaces, an open top, and an at least partially open bottom that provide a main body volume, wherein the main body is configured to receive a bulk product into the main body volume via the open top. The dispensing apparatus further includes a drop valve positioned below and connected to the main body at a pivot point, wherein the drop valve comprises a bottom surface and at least two side surfaces connected to a respective edge of the bottom surface to provide a drop valve volume, wherein the drop valve is configured to move about the pivot point between a closed position and an open position. In the closed position, the dispensing apparatus comprises a securing force configured to secure the bulk product positioned within the main body volume and the drop valve volume from exiting the dispensing apparatus. In the open position, the drop valve is configured to provide an opening for the bulk product positioned within the main body volume and the drop valve volume to exit the dispensing apparatus via gravity. Further, the drop valve is configured to move about the pivot point between the closed position and the open position via a dispensing force applied to the drop valve that is greater than the securing force.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The drawings described herein are for illustrative purposes only and illustrate selected embodiments of the present disclosure. The enclosed drawings are not intended to limit the scope of the present disclosure.

DETAILED DESCRIPTION

Figure 1:
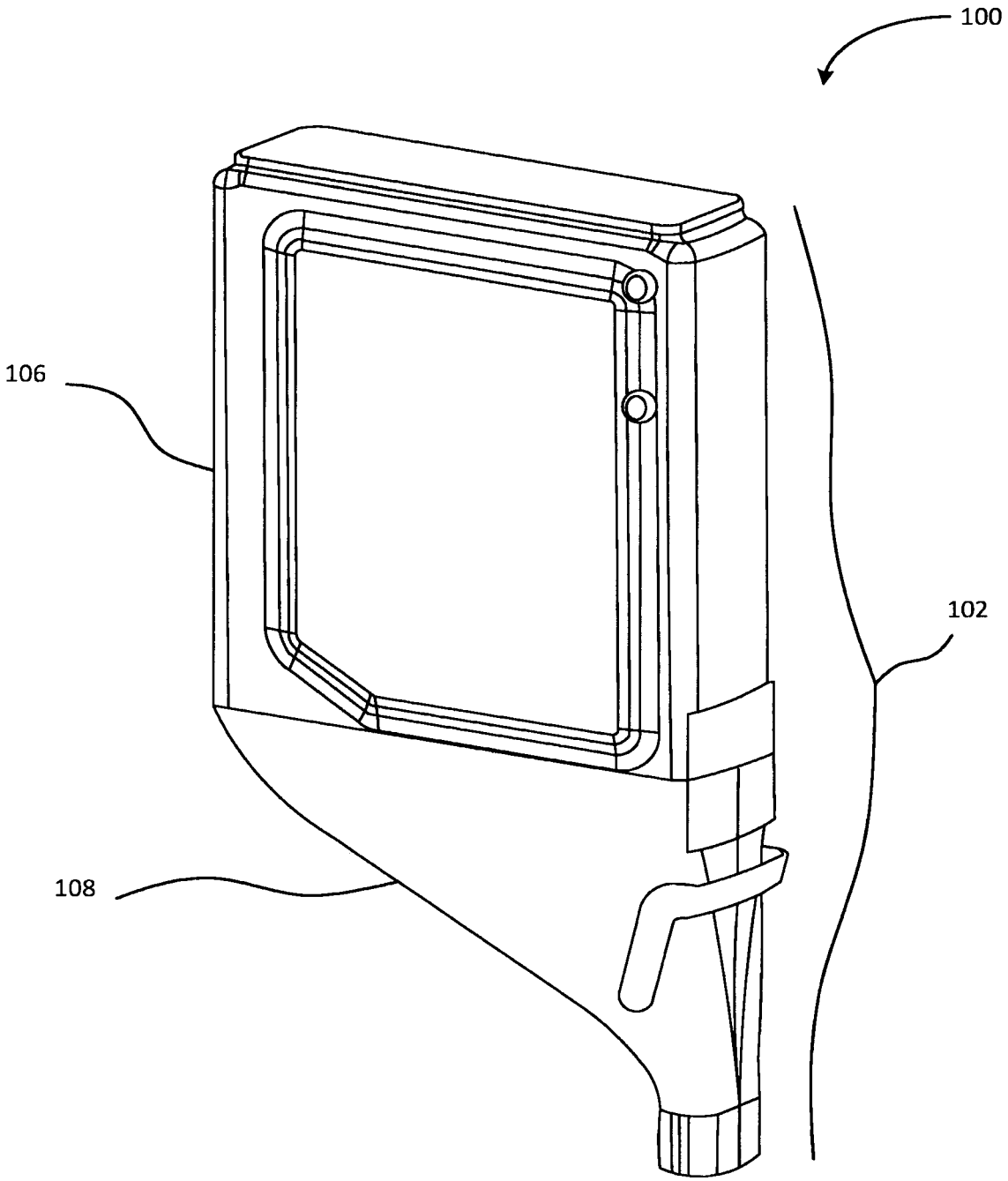
FIG. 1 depicts an example of a storage system. In this embodiment, the storage system includes a gravity-fed storage bin. The gravity-fed storage bin includes a hopper and a reservoir.

The devices, apparatuses, systems, and methods described herein provide storage and dispensing solutions to food and/or other items (e.g., dry goods, fluids, or various articles) that may be stored and sold in bulk. In certain examples, the devices, apparatuses, systems, and methods described herein may include a gravity-fed product carrier or dispensing apparatus configured to house and dispense bulk product.

The devices, apparatuses, systems, and methods disclosed herein may be advantageous in their ability to remain sanitary while storing and dispensing bulk product as well. The devices, apparatuses, systems, and methods may have further advantages in reducing or eliminating the risk of having stale or expired product dispensed to customers. In other words, the devices, apparatuses, systems, and methods disclosed herein are advantageous in replacing expired or unwanted bulk product without contamination.

Furthermore, the devices, apparatuses, systems, and methods disclosed herein may be advantageous in their ability to efficiently replace and restock bulk product. The devices, apparatuses, systems, and methods may have further advantages in improving the time required to update bulk product and to clean product dispensing equipment.

Furthermore, the devices, apparatuses, systems, and methods disclosed herein may be advantageous in their ability to interact with existing bulk dispensing systems by providing a low-cost upgrade to existing systems via the cartridge mechanism, thereby improving efficiency and cleanliness of the existing system.

Definitions

As used herein, a bulk product may refer to a food, liquid, dry good, or article configured to be stored and dispensed from a bulk product dispensing apparatus.

As used herein, a bulk product dispenser, dispensing apparatus, or bulk storage bin may refer to a storage and delivery system/apparatus for a bulk product. Examples include gravity bin dispensers, scoop bins, inversion bins, "loss-in-weight" gravimetric feeders, volumetric feeders, or any bulk product delivery mechanism for the systems described herein.

In certain examples, the bulk product stored in the bulk product dispenser or dispensing apparatus may be a food product. Non-limiting examples of bulk foods nuts, dried fruit, snacks, spices, herbs, seasonings, seeds, chocolate, candy, beans, vegetables, rice, grains, pastas, cereals, and so on.

Additionally, or alternatively, the bulk product may include any type of dry food, dry good, liquid, or physical article (e.g., nails, bolts, screws, fasteners) that could be readily dispensed from a bulk product dispenser/dispensing apparatus.

Furthermore, in certain examples, the bulk product may be measured and valued by the overall dispensed product weight or volume, rather than by individual product item unit. This is advantageous in potentially tracking usage/sales of such products and/or eliminating the need to record individual product item numbers.

As used herein, a hopper may refer to the section of the product carrier or product storage bin that includes an internal volume configured to store the bulk product. The hopper may be configured to receive a replaceable storage bag to easily replace a depleted bin or change out a supply of an expired or low-selling product.

As used herein, a drop valve, dispensing chute, or food reservoir may refer to a spout or guided flow section of a bulk product dispenser or dispensing apparatus that is configured to control the exit of the bulk product via gravity or other mechanism. The drop valve may be configured to move between a closed position that retains the bulk product from exiting the dispensing apparatus and an open position that allows the bulk product to exit the dispensing apparatus. The drop valve may be configured to have a variable opening amount (e.g., the drop valve may be configured to be opened 0%, 25%, 50%, 75%, 100%, or any percentage in between).

As used here, an open position may refer to a fully open position of a drop valve or dispensing chute such that the drop valve is restricted from moving any further along a track. An open position may additionally refer to an at least partially open position of the drop valve that is positioned somewhere along the track between a closed position and the fully open position. Unless identified otherwise, the term open position may refer to both the fully open or a partially open position.

As used herein, the singular forms "a," "an," and "the" include plural referents unless the context clearly dictates otherwise.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

An Embodiment of an Apparatus for a Storage System

Figure 2:
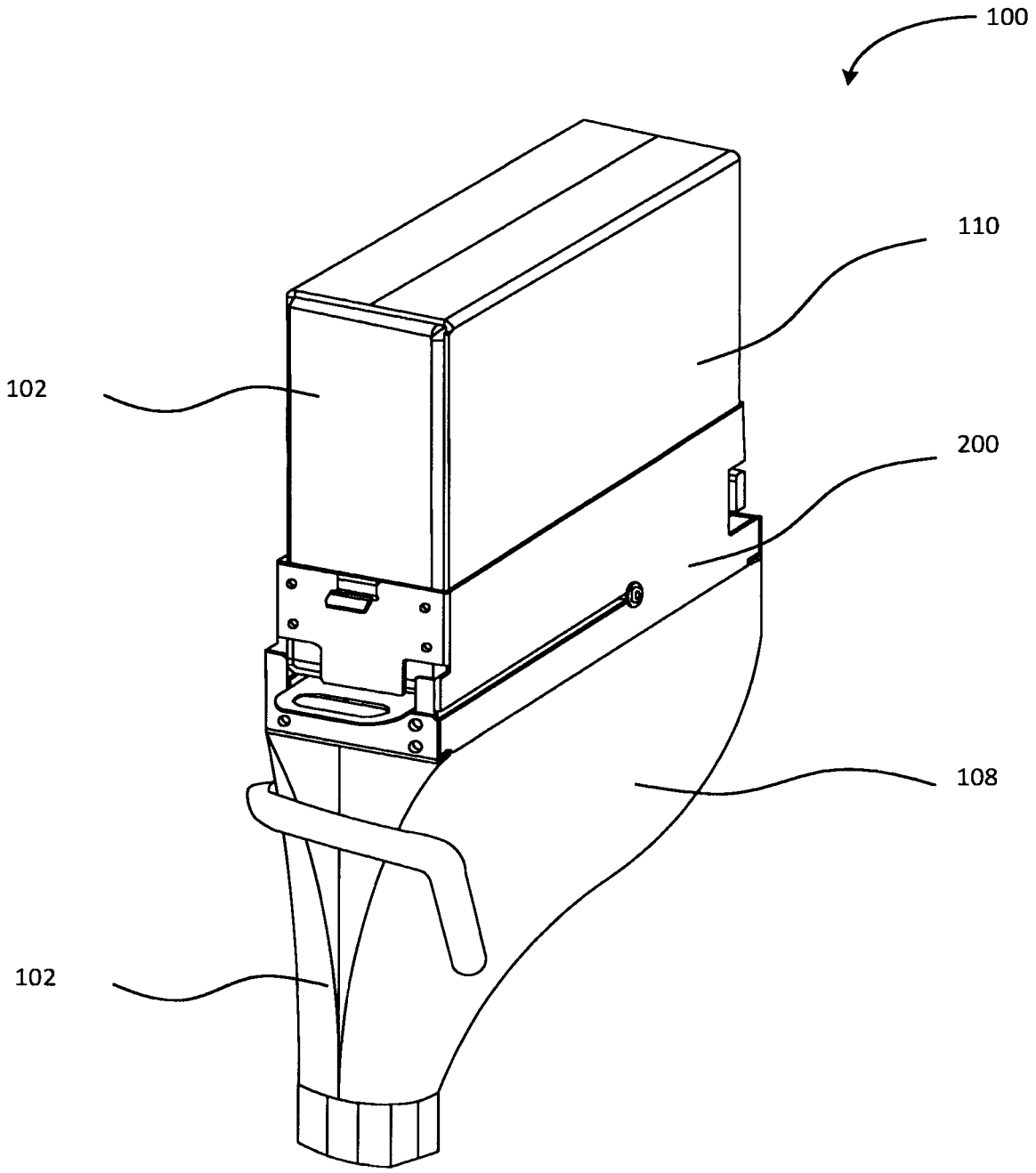
FIG. 2 depicts an example of a storage system and a bulk item container. In this embodiment, the storage system includes a gravity-fed storage bin and a cartridge carrier.
Figure 3:
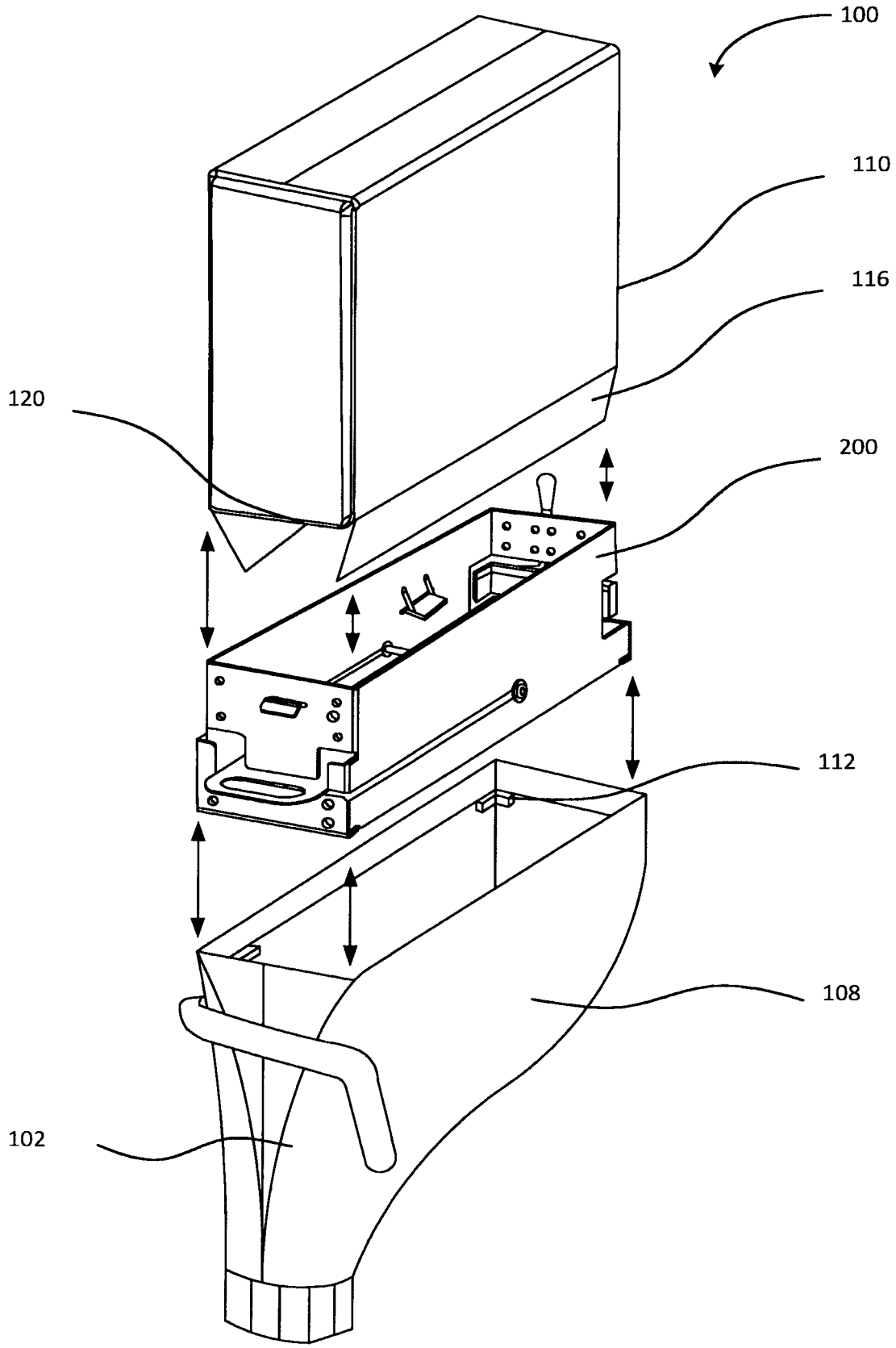
FIG. 3 depicts another example of a disassembled storage system and a bulk item container. In this embodiment, the storage system includes a gravity-fed storage bin and a cartridge carrier.

FIGS. 1-3 depict embodiments of storage systems that may include a gravity-fed storage bin configured to store and dispense a bulk item container, and a cartridge carrier. In these examples, the cartridge carrier is configured to receive the bulk item container into a cartridge carrier volume via an open top box.

For example, FIGS. 1-3 depict an example of a storage system 100 that includes an integrated gravity-fed storage bin 102 and a cartridge carrier 200.

FIG. 1 depicts the gravity-fed storage bin 102 that may include a hopper 106 configured to store the bulk item (e.g., food) inside a bulk item container 110. The storage bin further 102 further includes a reservoir 108. The hopper 106 may be configured to receive and house the bulk item container 110 (e.g., bag, inner container, bulk food container, and the like) containing the bulk product along with the cartridge carrier 200 (see FIGS. 2-3). This is advantageous in removing an empty container, expired bulk food item, or low-selling item with a new full container without contaminating the inner surface of the hopper 106 with the bulk food. In other words, the bulk item container 110 could be removed and replaced with a second, different bulk item container on-the-fly with little cleaning of the hopper 106 and minimal cross-contamination between different bulk food items.

The gravity-fed storage bin 102 may also include a chute or reservoir 108 positioned at the base of the hopper 106. The reservoir 108 provides an intermediate location between the hopper 106 and dispensing of the bulk food into a bag or container of a customer. The reservoir 108 may be advantageous in providing a visible identification of the bulk food item that may be concealed within the hopper 106. Additionally, the reservoir 108 may advantageously provide extra storage volume to store the bulk food items. In other words, when the hopper 106 has been emptied, a remaining amount of bulk food may be stored within the reservoir 108. This allows for easy removal and replacement of the bulk item container 110 in the hopper 106 with little or no bulk food being wasted (e.g., the hopper 106 can be completely emptied prior to replacement because a percentage of the bulk food originally stored in the bulk item container 110 within the hopper 106 remains within the reservoir 108).

FIG. 2 depicts an example of the storage system 100 where the hopper 106 of the gravity-fed storage bin 102 is not illustrated to depict the cartridge carrier 200 positioned on top of the reservoir 108. The gravity-fed storage bin 102 and the cartridge carrier 200 are separate from each other. The cartridge carrier 200 is configured to receive and secure the bulk item container 110 containing the bulk food. The cartridge carrier 200 is further configured to be positioned within the area of the hopper 106 of the gravity-fed storage bin 102. The cartridge carrier 200 is configured to be positioned above the reservoir 108 of the gravity-fed storage bin 102. The cartridge carrier 200 may have an area or section near the base of the cartridge carrier 200 that is configured to be opened after the bulk item container 110 has been inserted and secured into the cartridge carrier 200. Once in the cartridge carrier 200, the bulk item container 110 may be opened by an operator by sliding a sliding mechanism (described below) of the cartridge carrier 200, between a first position and a second position, to provide a bottom opening to allow the bulk item to drop from the bulk item container 110 into the reservoir 108 of the gravity-fed storage bin 102 via gravity.

FIG. 3 depicts an example of the storage system 100 where the cartridge carrier 200 is separated from the reservoir 108. Additionally, the bulk item container 110 is depicted separated from the cartridge carrier 200 where the container is configured to rest. As depicted, the bulk item container 110 includes two flaps 116 on the bottom 120 of the bulk item container 110. The flaps 116 are configured to move between a closed position to an open position to distribute the bulk items into the reservoir 108 of the gravity-fed storage bin 102.

In this example, the cartridge carrier 200 may be configured to rest on supports 112 positioned on internal walls within the reservoir 108 of the gravity-fed storage bin 102. The supports 112 may be positioned within the reservoir 108 to provide a gap between a bottom 120 of the bulk item container 110 and a top surface of the bulk items dispensed into the reservoir 108 of the gravity-fed storage bin 102. For example, the gap between the bottom 120 of the bulk item container 110 and the top surface of bulk items within the reservoir 108. This advantageously allows for room for the bulk items to be efficiently dispensed into the reservoir 108, thereby preventing any overflow of food being dispensed into the reservoir 108. Additionally, the gap provided by the positioning of the supports 112 may allow the flaps 116 of the bulk item container 110 to be fully opened and directed downward, parallel with the adjacent wall of the reservoir 108, therein providing easier distribution of the bulk item into the gravity-fed storage bin 102.

Figure 4:
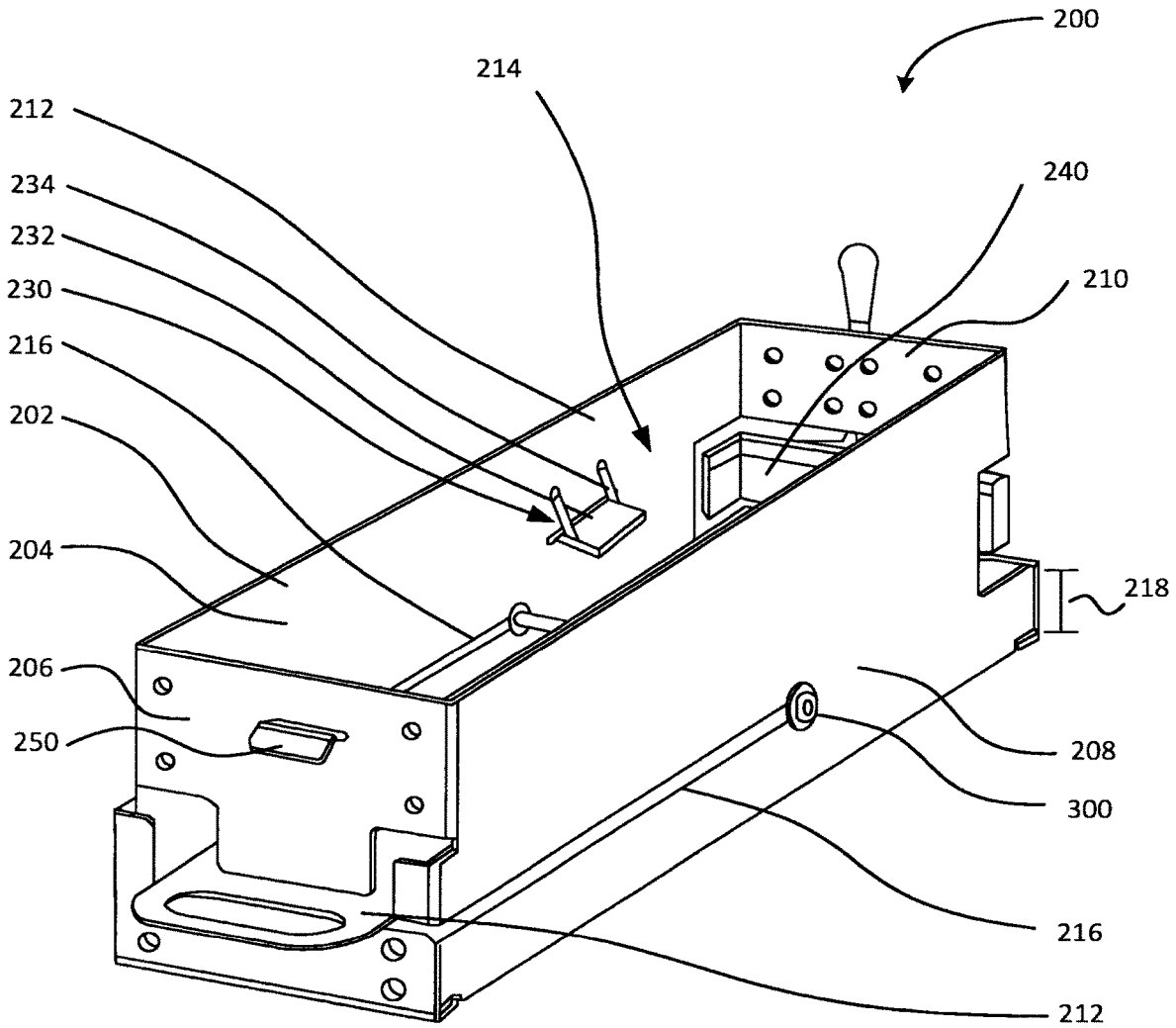
FIG. 4 depicts a perspective view of a cartridge carrier when a bulk item container has not been inserted into a cartridge carrier volume of the cartridge carrier.

FIG. 4 depicts a perspective view of an example of a cartridge carrier 200 when the bulk item container (not illustrated) has not been inserted into a cartridge carrier volume 214.

In this example, the cartridge carrier 200 includes an open top box 202 having four side surfaces (e.g., walls) 204, 206, 208, and 210, and a bottom surface 212. The side surfaces and bottom surface form a cartridge carrier volume 214 having an open top. Further, side surfaces 204 and 208 each have a horizontal slot 216 extending a certain distance, parallel with the bottom surface 212, from side surface 206 of the open top box 202. Each of the horizontal slots 216 are positioned a certain distance above each respective bottom edge of the four side surfaces 204, 206, 208, and 210. The distance each horizontal slot 216 is positioned above each respective bottom edge of the four side surfaces 204, 206, 208, and 210, is configured to provide an internal volume 220 beneath the bottom surface 212, further described below.

The cartridge carrier 200 is configured to be positioned above the reservoir 108 of a gravity-fed storage bin 102. The open top box 202 is configured to receive the bulk item container 110 into the cartridge carrier volume 214 via the open top of the open top box 202.

The bottom surface 212 of the open top box 202 is further configured to move from a first (closed) position into a second (open) position (e.g., using a sliding mechanism 300) to release a bulk item of the bulk item container 110 into the gravity-fed storage bin 102 via gravity.

Furthermore, each of the side surfaces 204, 206, 208, and 210 of the open top box 202 includes a segment 218 of the side surface that extends a distance below the bottom surface 212 in a direction of the gravity-fed storage bin, to provide the internal volume 220 beneath the bottom surface 212 (as mentioned above). In other words, the segment 218 may be any distance below the bottom surface 212 to provide an internal volume 220 beneath the bottom surface 212. The internal volume 220 is configured such that when the sliding mechanism 300 is used to move the bottom surface 212 to the second position, the bulk items in the bulk item container 110 are dropped into the gravity-fed storage bin 102 via gravity. This advantageously allows for room for the bulk items to be efficiently dispensed into the reservoir 108, thereby preventing any overflow of food being dispensed into the reservoir 108. Additionally, the internal volume 220 may allow the flaps of the bulk item container to be fully opened and directed downward, parallel with the adjacent wall of the reservoir, therein providing easier distribution of the bulk item into the gravity-fed storage bin.

The bottom surface 212 of the open top box includes the sliding mechanism 300 configured to slide the bottom surface 212 so that bulk items in a bulk item container can be dropped into the gravity-fed storage bin 102 via gravity. The sliding mechanism 300 may be a rod attached horizontally along a back end of the bottom surface 212. Each end of the sliding mechanism 300 may be disposed in either of the horizontal slots 216 of side surfaces 204 and 208, such that the sliding mechanism 300 can slide along the horizontal slots 216 of side surfaces 204 and 208. For example, the sliding mechanism 300 is attached horizontally along the back end of the bottom surface 212, and each end of the sliding mechanism 300 is disposed in each horizontal slot 216 of the side surface 204 and 208 to provide a sliding (e.g., moving) function of the bottom surface 212.

The sliding mechanism 300 is configured to move the bottom surface 212 between a first (closed) position and a second (open) position. FIG. 4 depicts the sliding mechanism 300 in the first (closed) position. In the first position, the bottom surface 212 is positioned horizontally to form a cartridge carrier volume 214 having an open top. In the first position, the open top box 202 is configured to secure a bulk item of the bulk item container 110, positioned within the cartridge carrier volume 214. In the first position, the sliding mechanism is configured to prevent a bulk item of the bulk item container from being dropped (e.g., dispensed) into the reservoir 108 of the gravity-fed storage bin 102 via gravity. In the second position, the bottom surface 212 is slid (e.g., removed, moved, and the like) out of the cartridge carrier 200 and positioned vertically. In the second position, the open top box 202 is configured to provide a bottom opening allowing the bulk item to drop from the bulk item container 110 into the reservoir 108 of the gravity-fed storage bin 102 via gravity.

FIG. 4 further depicts a flap folder 230 positioned on the side surface 204 of the open top box 202. The flap folder 230 may be positioned on any of the side surfaces of the four side surfaces and is not limited to the side surface 204. The flap folder 230 is configured to control a position of a flap 116 of the bulk item container 110 when the bulk item container 110 is being received into the cartridge carrier volume 214. The flap folder 230 includes a flap 232 and a spring-loaded mechanism 234 configured to move the flap 232 between an extended position and a compressed position. For example, the spring-loaded mechanism 234 is in a relaxed state when keeping the flap 232 in an extended position (e.g., horizontal position). When the flap 232 is moved by the bulk item container 110 being inserted into the cartridge carrier volume 214, the spring-loaded mechanism 234 is in a compressed position (i.e., keeping the flap 232 in a vertical position so that the flap 232 is compressed against the side surface 204). Once the bulk item container 110 is removed from the cartridge carrier volume 214, the spring-loaded mechanism 234 is restored to its relaxed state, having the flap 232 in its extended position (i.e., its initial position wherein the flap 232 is positioned horizontally). The spring-loaded mechanism 234 may be any spring that produces a restoring force when stretched or compressed.

For example, FIG. 4 depicts the flap 232 of the flap folder 230 in the extended position. When the flap 232 of the flap folder 230 is in the extended position, the flap 232 is configured to extend horizontally within the cartridge carrier volume 214, parallel with the bottom surface 212 of the open top box 202 in its first (closed) position. The flap 232 is configured to receive a flap 116 (illustrated in FIG. 3) of the bulk item container 110 when the bulk item container 110 is being received into the cartridge carrier volume 214. This is advantageous in securing and positioning the flap 116 of the bulk item container 110 in a specific configuration. Specifically, the flap 232 may advantageously receive the flap 116 of the bulk item container 110 prior to the bulk item container 110 contacting the bottom surface 212 of the open top box 202. This allows the flap 232 of the flap folder 230 to adjust an orientation of the flap of the bulk item container 110 prior to the container resting on the bottom surface 212. This may advantageously allow for the bulk item container 110 and bottom surface 212 to be opened more smoothly and the bulk item distributed more efficiently.

Figure 5:
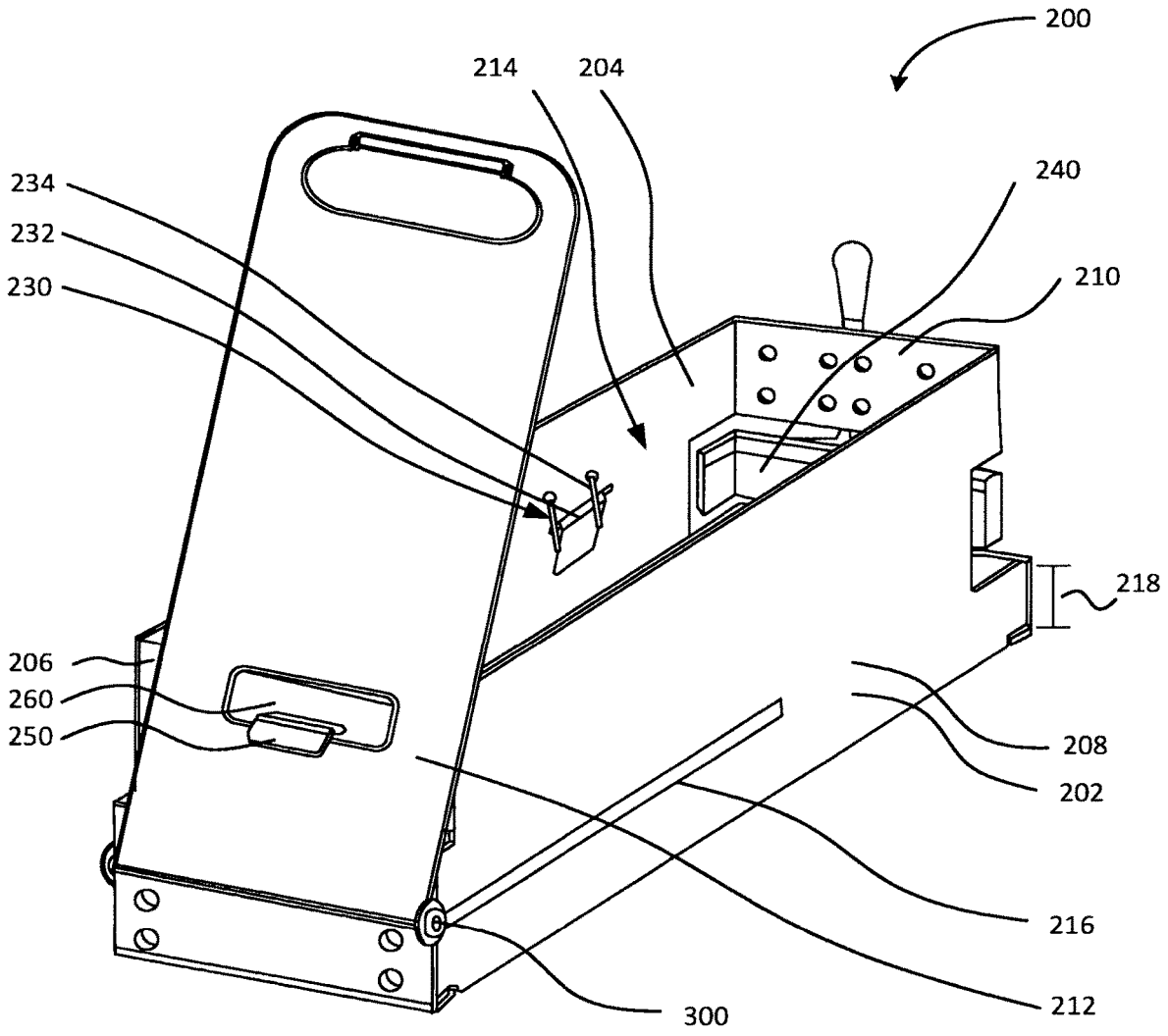
FIG. 5 depicts a perspective view of a cartridge carrier when a bulk item container has been inserted into a cartridge carrier volume of the cartridge carrier.

FIG. 5 depicts a second perspective view of the cartridge carrier 200 when the bulk item container (not illustrated) has been inserted into the cartridge carrier volume 214.

As mentioned above, the open top box 202 is configured to move (e.g., release) a bulk item of the bulk item container 110 into the gravity-fed storage bin 102 via gravity, using the sliding mechanism 300. The sliding mechanism 300 is configured to move the bottom surface 212 between a first (closed) position and a second (open) position. In this second (open) position, the open top box 202 has a bottom opening allowing the bulk item to drop from the bulk item container 110 into the reservoir 108 of the gravity-fed storage bin 102 via gravity.

FIG. 5 depicts the sliding mechanism in the second (open) position. In the second position, the bottom surface 212 is slid (e.g., removed or moved) out of the cartridge carrier volume 214 of the cartridge carrier 200. In this example, the removed bottom surface 212 may be secured to the outer surface of the side wall 206 of the open top box 202, e.g., in a vertical position, parallel with the side wall 206. A securing element 250 such as a hook may be positioned on the outer surface of the side wall 206 to assist in securing the removed bottom surface 212. A corresponding opening 260 in the bottom surface 212 may be configured to receive the securing element 250 (e.g., hook) to secure the bottom surface 212 in the vertical position.

FIG. 5 depicts the flap 232 of the flap folder 230 in the compressed position. When the flap 232 of the flap folder 230 is in the compressed position, the flap 232 is configured to be positioned vertically, perpendicular with the bottom surface 212 of the open top box 202, in between the side surface 204 of the open top box 202 and a side surface of the bulk item container 110. The flap 232 of the flap folder 230 is in the compressed position after the bulk item container 110 has been received inside the cartridge carrier volume 214, and the position of the flap 116 (illustrated in FIG. 3) of the bulk item container 110 has been secured. The compressed position of the flap 232 advantageously allows the bulk item container to be opened and the bulk item distributed into the gravity bin.

Figure 6:
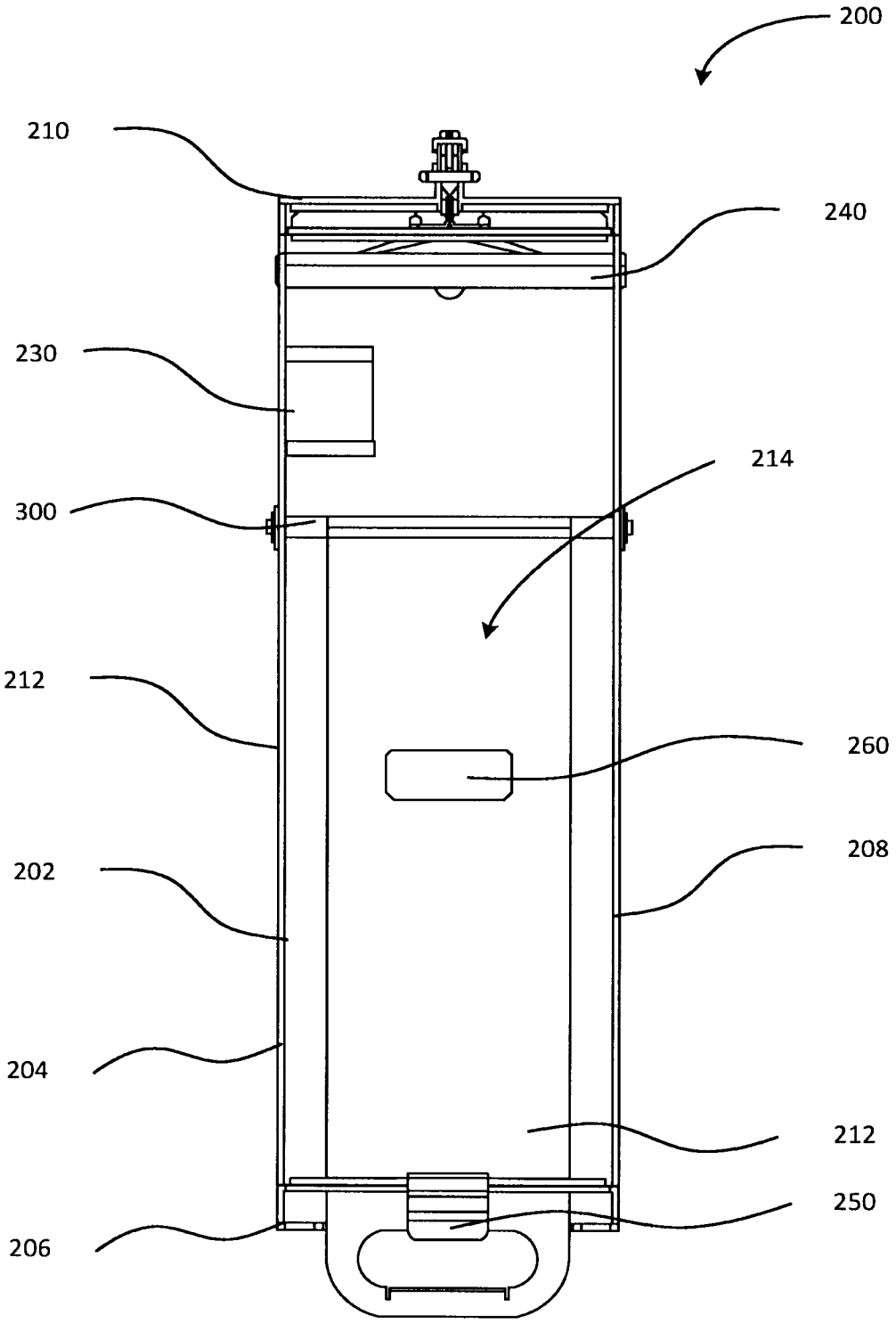
FIG. 6 depicts a top view of a cartridge carrier.
Figure 7:
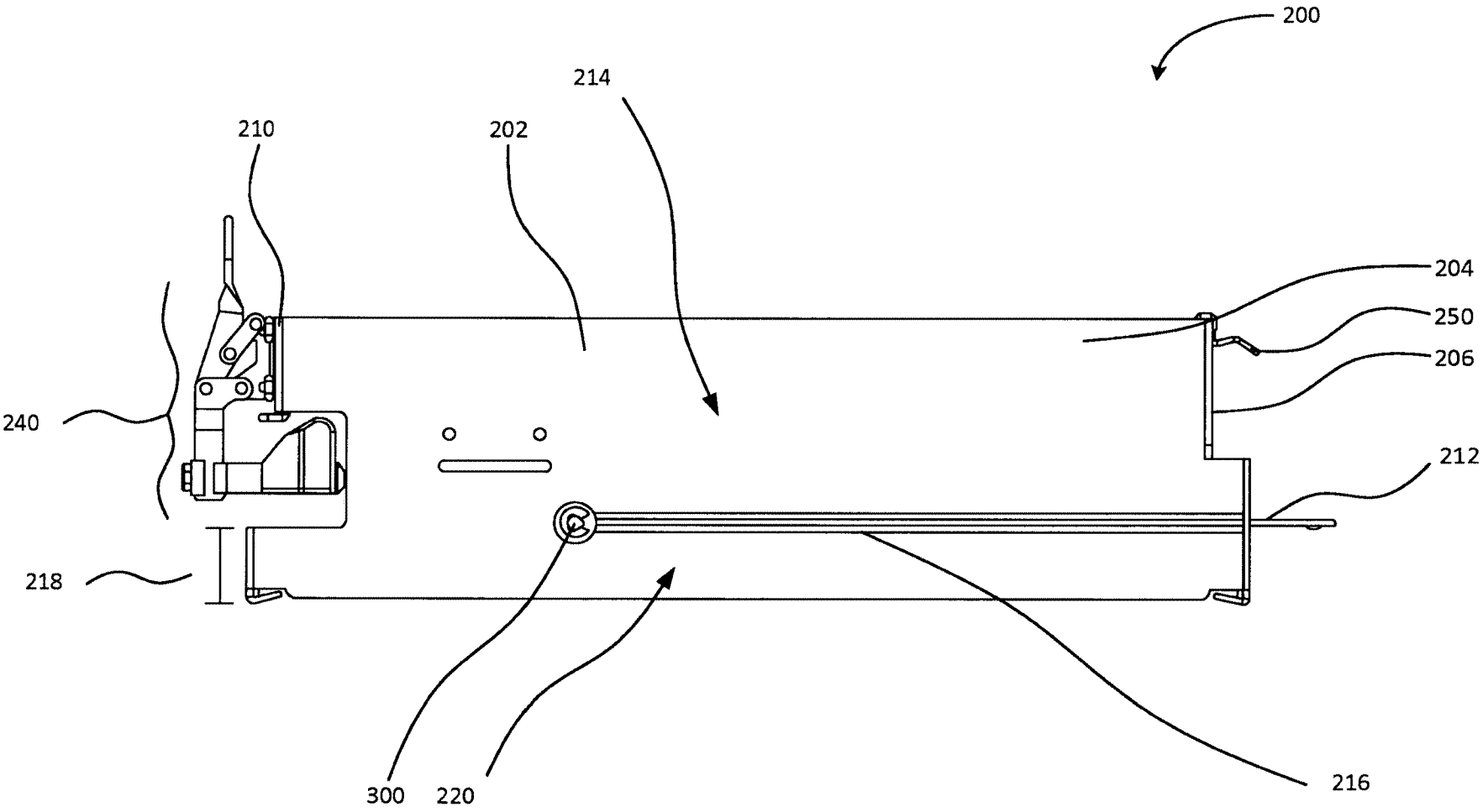
FIG. 7 depicts a side view of a cartridge carrier.

FIGS. 6 and 7 depict additional views of the cartridge carrier. FIG. 6 depicts a top view of the cartridge carrier 200. FIG. 7 depicts a side view of the cartridge carrier 200.

In these figures, an adjustable clamp 240 of the cartridge carrier 200 is depicted in detail. The adjustable clamp 240 is positioned on the side surface 210 of the four side surfaces of the open top box 202. The adjustable clamp 240 could be positioned on one of the other side surfaces instead. The adjustable clamp 240 is configured to secure the bulk item container 110 from moving within the cartridge carrier volume 214 of the open top box 202 of the cartridge carrier 200. For example, after the bulk item container 110 is placed into the cartridge carrier volume 214 of the cartridge carrier 200, an operator may operate the adjustable clamp 240 to secure the bulk item container 110 such that the bulk item container cannot move within the cartridge carrier volume 214. This may be accomplished by moving a lever of the clamp or twisting a screw to move one end of the clamp from an open position to a closed position such than the end of the clamp provides a secure fit against a side surface of the bulk item container. This may be advantageous in improving the process of transferring or dumping the bulk item into the gravity bin.

Figure 8:
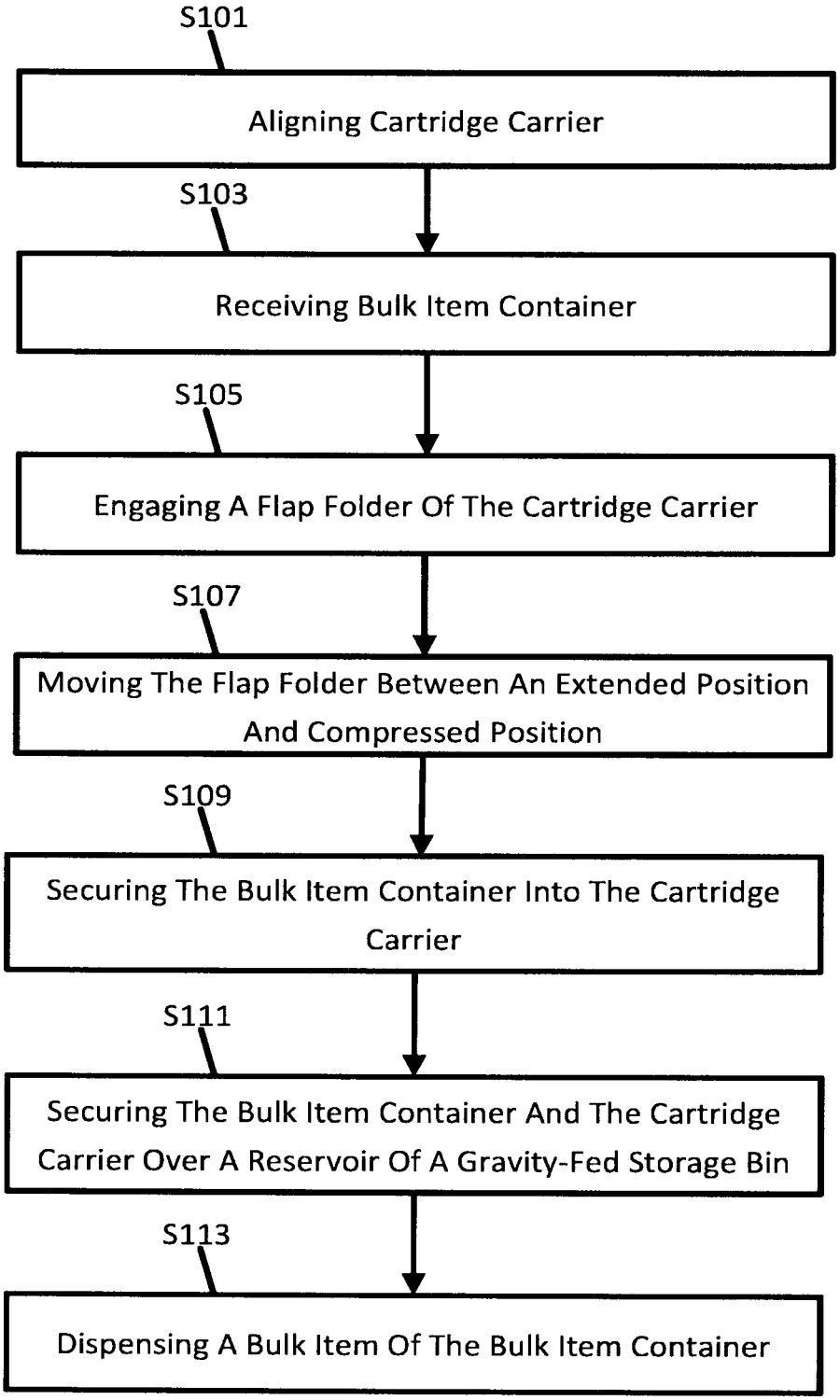
FIG. 8 illustrates a flow chart for a method for receiving a bulk item container into a cartridge carrier of a storage system.

FIG. 8 illustrates a flow chart for a method for receiving a bulk item container 110 into a cartridge carrier 200 of the storage system 100. At act S101, the cartridge carrier 200 is aligned over an opening of the bulk item container 110. The bottom 120 of the bulk item container 110 is opened by removing any tape or adhesive keeping the flaps 116 of the bottom 120 of the bulk item container closed. The bulk item container 110 is positioned such that the bottom 120 is now facing upward so that none of the bulk items can fall out of the bulk item container when the adhesive is removed. The cartridge carrier 200 is inverted so that when it is aligned above the bottom 120 of the bulk item container 110, the bulk item container 110 is received through the opening of the open top box 202 of the cartridge carrier 200.

At act S103, the bulk item container 110 is received through the opening of the open top box 202 of the cartridge carrier 200.

At act S105, the flap folder 230 of the cartridge carrier 200, positioned in an extended position, is engaged with a flap on a bottom surface of the bulk item container when the bulk item container 110 is being received into the cartridge carrier volume 214. In the extended position, the flap 232 extends horizontally within the cartridge carrier volume 214, parallel with the bottom surface 212 of the open top box 202, to receive the flap 116 of the bulk item container 110 when the bulk item container 110 is being received into the cartridge carrier volume 214.

At act S107, the flap 232 of the flap folder 230 is moved between the extended position and the compressed position. In the compressed position, the flap 232 is positioned vertically, perpendicular with the bottom surface 212 of the open top box 202, in between the side surface of the open top box 202 and the bulk item container 110 after the bulk item container 110 has been received inside the cartridge carrier volume 214 and the position of the flap 116 of the bulk item container 110 has been engaged.

In act S109, the bulk item container 110 is secured into the cartridge carrier volume 214 with an adjustable clamp 240. The adjustable clamp 240 compresses the bulk item container 110 against at least one side surface of the four side surfaces of the open top box 202.

In act S111, the cartridge carrier 200 is secured with the secured bulk item container 110 over the reservoir 108 of the gravity-fed storage bin 102. The cartridge carrier 200 is configured to rest on supports 112 that are positioned within the reservoir 108 of the gravity-fed storage bin 102 to provide a gap between a bottom 120 of the bulk item container 110 and a top surface of the bulk items dispensed into the reservoir 108 of the gravity-fed storage bin 102.

In act S113, a bulk item of the bulk item container is dispensed, by moving a sliding mechanism 300 of the bottom surface 212 of the open top box 202 of the cartridge carrier 200, from a first position to a second position. The first position secures a bulk item of the bulk item container 110 positioned within the cartridge carrier volume 214. The second position provides a bottom opening allowing the bulk item to drop from the bulk item container 110 into the gravity-fed storage bin 102 via gravity.

Additional Embodiments of Dispensing Apparatuses and Systems

FIGS. 9-21 depict embodiments of dispensing apparatuses/systems. In these embodiments, the dispensing apparatus may include a main body or product carrier configured to store a product (e.g., bulk product such as a bulk food) and a drop valve or dispensing chute configured to dispense the product from the container or main body. In certain examples, the main body or product carrier may function as a cartridge carrier that is configured to be inverted and placed over a storage bin or bulk item cartridge such as to have the bulk item cartridge be inserted into a bulk item or cartridge carrier volume via an open top box of the main body and subsequently flipped over to drop the bulk item within the bulk item cartridge into the main body or product carrier of the dispensing apparatus. Alternatively, in other embodiments, bulk items stored within a bag or cartridge may be poured into the volume of the main body or product carrier without involving inverting the main body over a bulk item cartridge.

Figure 9:
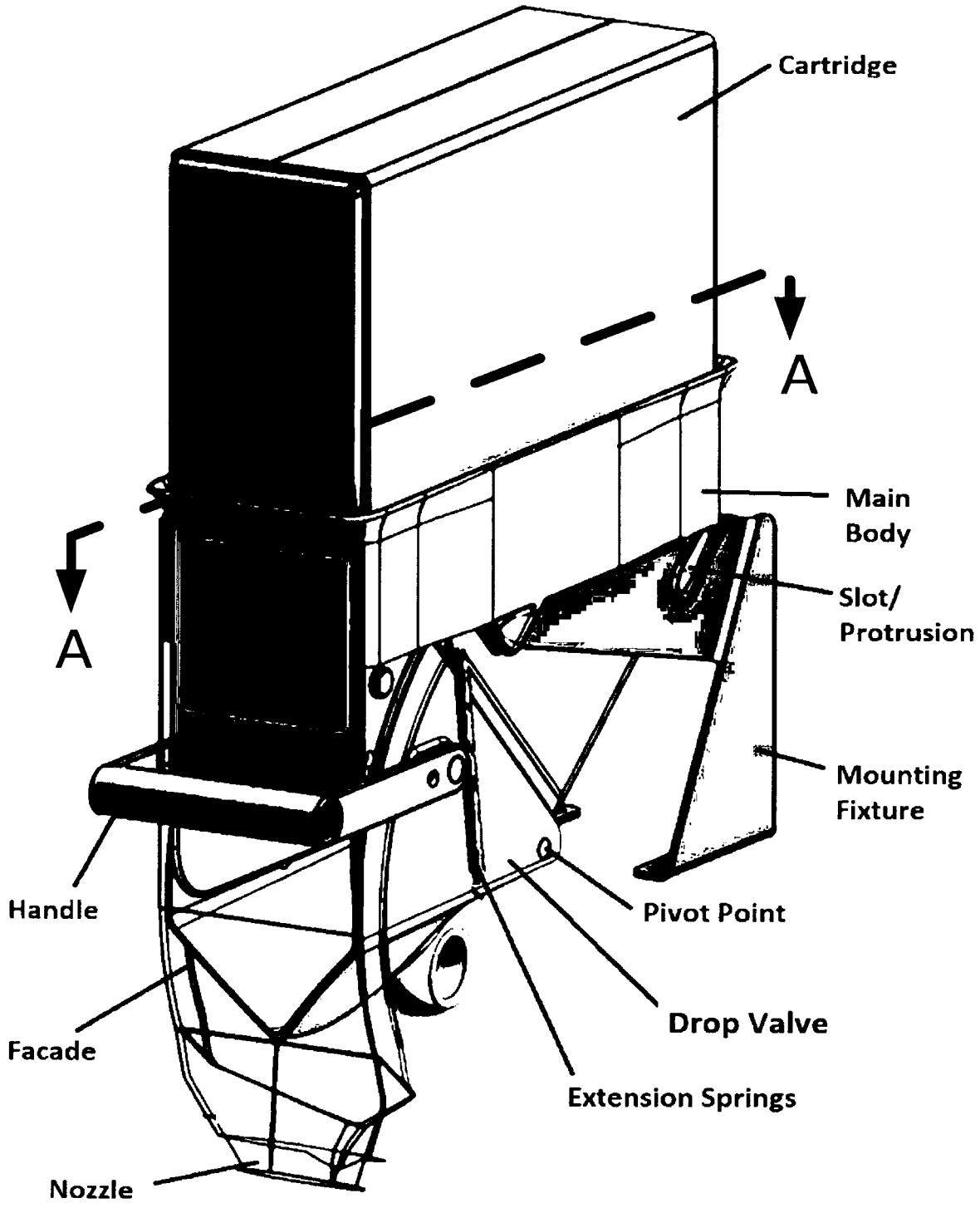
FIG. 9 depicts an example of a dispensing apparatus/system.
Figure 10:
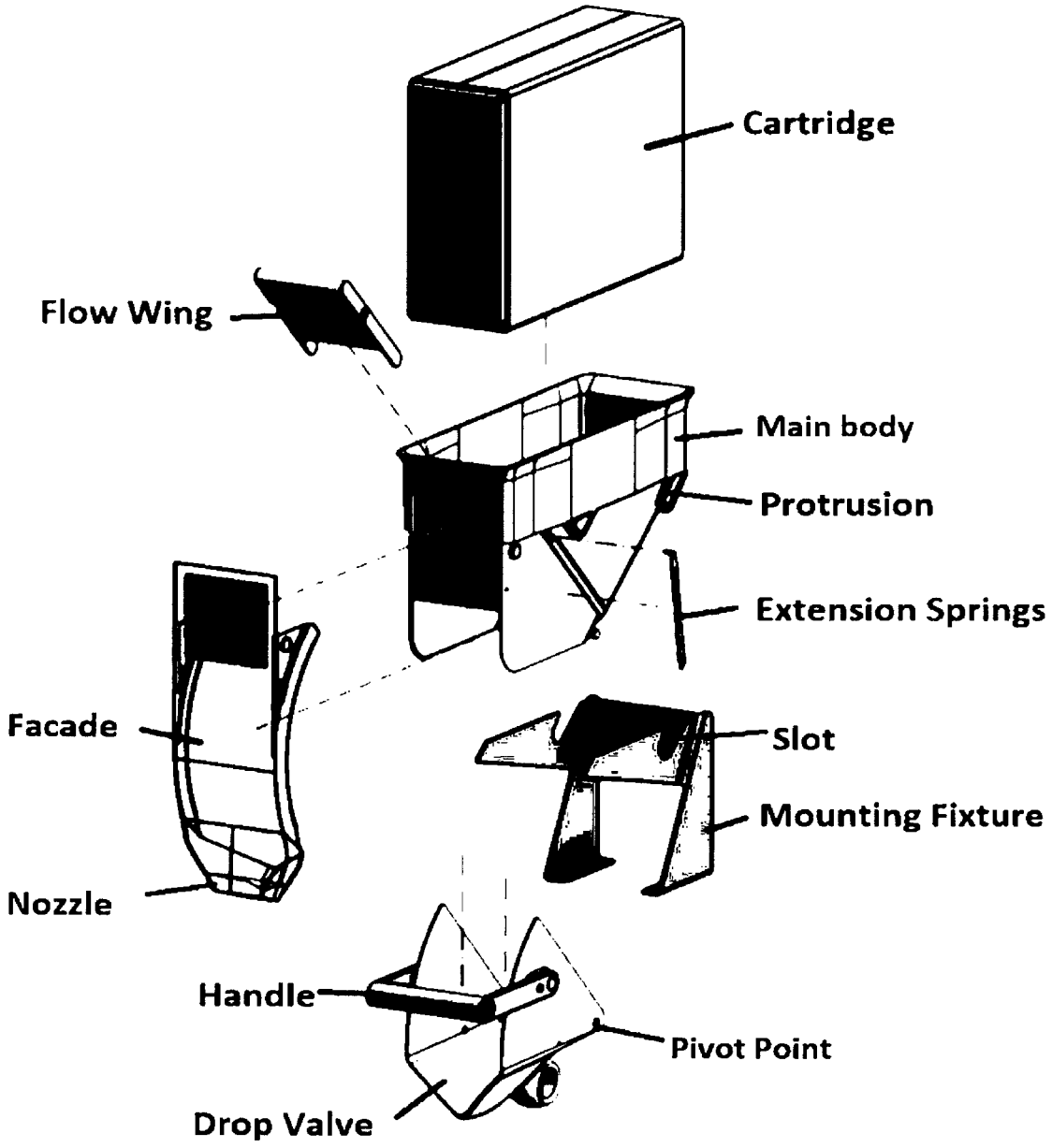
FIG. 10 depicts an exploded view of the dispensing apparatus/system of FIG. 9.

FIG. 9 depicts an example of a dispensing apparatus having a mounting fixture. FIG. 10 depicts an exploded view of the apparatus/system of FIG. 9.

Referring to FIGS. 9 and 10, the dispensing apparatus includes a main body or product carrier configured to receive a bulk product (e.g., from a bulk product cartridge, bin, or bag) into the volume of the main body or product carrier.

The main body/product carrier has four side surfaces, an open top, and an at least partially open bottom that provide a main body volume. The four side surfaces include a front side surface, a back side surface, a left side surface, and a right side surface. The left and right side surfaces of the main body include a fixture joint or protrusion that is configured to be fixed and secured within a respective slot/opening of the mounting fixture of the apparatus/system. In other words, the left side surface of the main body includes a left side fixture joint or protrusion, and the right side surface of the main body includes a right side fixture joint or protrusion. Each fixing mechanism is configured to be fixed to a respective side of the mounting fixture such as to limit the movement of the apparatus when the apparatus is fixed to the mounting fixture. The mounting fixture is configured to support the apparatus such that the apparatus is securely positioned on a shelf.

The main body of the dispensing apparatus may be configured to be secured onto and removed from the mounting fixture, which is configured to be secured to a surface, such as a wall. In other words, the dispensing apparatus may advantageously be removed from the mounting fixture when the dispensing apparatus/system needs to be refilled.

Additionally, as depicted in FIGS. 9 and 10, each top edge of the four side surfaces of the main body/product carrier may be flared out to assist in inserting the bulk product container into the main body volume.

The main body/product carrier is configured to receive the bulk product container into the main body volume via the open top of the main body. In other words, the main body of the apparatus may be aligned over an opening of the bulk product container. The bottom of the bulk product container, as depicted in FIGS. 9 and 10, may be positioned facing upward and subsequently opened by removing any tape or adhesive keeping the flaps of the bottom of the bulk product container closed so that none of the bulk product can fall out of the bulk product container when the adhesive is removed.

In certain examples, main body/product carrier (removed from the mounting fixture) may be inverted or positioned upside-down to be secured on top of an inverted single-use bulk product cartridge with the bottom flaps of the bulk product cartridge opened so that when the main body is aligned above the bulk product container (also inverted), the bulk product container is received through the opening of the open top of the main body. In certain examples, each top edge of the four side surfaces of the main body is flared, therein advantageously allowing the bulk product container to be easily inserted into the main body volume.

The main body and attached bulk product cartridge may subsequently be turned back over to dispense at least some of the bulk product into the main body volume. Subsequently, the main body may be re-secured to the mounting fixture of the dispensing apparatus/system.

The apparatus further includes a drop valve or dispensing chute positioned below the main body. The drop valve may include a bottom surface and at least two side surfaces configured to provide a drop valve volume.

The drop valve may be connected to or in communication with the main body via a pivot point or hinge. The drop valve may be configured to move about the pivot point or hinge to create a variable opening via movement between a (fully) closed position and a (fully) open position. In certain examples, the movement of the drop valve may occur via a dispensing force applied by an operator to the drop valve (e.g., by actuation or pulling of a dispensing handle attached to the drop valve). When in the closed position, the drop valve is configured to secure the bulk product from the bulk product container positioned within the main body volume from exiting the apparatus. When in a fully open position or at least partially open position at some intermediate opening position between the fully closed or fully open position (herein referred to collectively as an "open position"), the drop valve is configured to provide an opening for the bulk product from the bulk product container positioned within the main body volume to exit the apparatus via gravity. Furthermore, in the open position, the drop valve is configured to assist in agitating the bulk product within the dispensing apparatus via gravity (i.e., the bulk product movement from the main body section of the dispensing apparatus into the lowered drop valve), therein improving the process of dispensing or transferring the bulk product out of the dispensing apparatus. This agitation of the bulk product is furthermore advantageous in keeping certain bulk product or bulk food from binding to each other within the dispensing apparatus.

In certain examples, the pivot point may be positioned adjacent to the back side surface of the main body, such that the bottom surface of the drop valve extends the entire length between the front and back sides of the main body, wherein the entire bottom surface is configured to move between the closed an open positions to dispense the bulk product. Alternatively, the pivot point may be positioned at an intermediate location between a back side surface and a front side surface of the main body such that the bottom surface of the drop valve does not extend an entire length between the front side surface and the back side surface of the main body (e.g., at a midway point between the front side and back side of the main body). In such an embodiment, the main body includes a partial bottom surface extending from the back side surface toward the pivot point location. In certain examples, such as depicted in the figures, this partial bottom surface of the main body may be positioned at an angle sloping downward from the back side surface toward the pivot point location to assist in transferring the bulk item or product from the main body when the drop valve is moved into the open position.

The drop valve may include two side surfaces and a bottom surface. When in the closed position, the two side surfaces and bottom surface form an internal volume having an open top. The two side surfaces (i.e., left and right side surfaces) of the drop valve are connected to a respective edge of the bottom surface of the drop valve such as to form the internal volume.

Furthermore, the bottom surface of the drop valve may be formed to have a curved shape (i.e., parabolic shape or "U" shape) or a "V" shape. Such a curved or "V" shape may be advantageous in directing the bulk product being dispensed into a central location at the base of the curved or "V" for easy transfer and collection by the operator of the system. Additionally, such a curved or "V" shape bottom surface may be advantageous in creating a wider shape or configuration as the drop valve opens, therein assisting in the bulk product transfer.

However, in alternative embodiments, the bottom surface of the drop valve may be formed to be any shape to assist in funneling or transferring bulk product out of the bulk product container when the drop valve is open. In other words, the shape and slope of the bottom surface of the drop valve advantageously assists in the flow and controlled release of the bulk product.

In certain embodiments, the drop valve may include a ring holder positioned on a bottom surface of the drop valve that may function as a carrying mechanism when the drop valve is detached from the surrounding components. Alternatively, the ring holder or carrying mechanism may function as an alternative location for actuating/facilitating the opening of the drop valve to dispense the bulk product.

The dispensing apparatus may include an interface mechanism or device configured to move the drop valve between a fully closed and fully open position (or an intermediate partially open position somewhere between the fully closed and fully open position). In certain examples, the interface mechanism may be a pulley, latch, handle, or other mechanical device attached to the drop valve to move the drop valve between the closed and open positions. In one particular example, the interface mechanism is a handle that may be attached to the drop valve, e.g., on each side of the drop valve. The location of the attachment(s) for the handle is configurable. The handle is configured to assist in holding and maneuvering the dispensing apparatus to dispense the bulk product. In certain examples, the handle may be cylindrically shaped. Other shapes such as rectangular prisms or cuboids are also possible. In certain examples, the handle may have a hollow center. Such a hollow center (combined with a clear or partially opaque composition) may be advantageous for inserting information into the handle for the operator or user of the dispensing system to read. The information may include product information (e.g., type of product, cost per weight or volume of product, etc.) Additionally, or alternatively, the information inserted into the hollow opening of the handle may include operating instructions for the user/operator to follow when dispensing the bulk product.

Additionally, or alternatively, an electronic sensor may be inserted into the dispensing handle to assist in monitoring the usage/dispensing of the bulk product. The electronic sensor may be an accelerometer, magnetometer, hall-effect, or tilt sensor configured to monitor a movement of the handle. Further, the sensor may be configured to transmit data summarizing and/or indicating movement of the handle. In certain examples, the data from the sensor may include a variety of metrics, including but not limited to the angle of the handle or dispensing chute and an identifier for the individual apparatus or bulk product contained therein. A variety of mechanisms to realize the transmission from the sensor may be employed, including but not limited to wired transmission, wireless transmission, ultrasonic, and optical.

In another example, the dispensing apparatus or system may also include an actuator. In this example, the actuator may be coupled to the drop valve and configured to assist in opening and closing the drop valve.

The dispensing apparatus may further include at least one securing or force retention device configured to provide a securing force to prevent the drop valve from opening unexpectedly/undesirably. In other words, the force retention device is configured to provide a resistance against pivot of the chute into the open position by providing the securing force and pulling the chute into the closed position. In certain examples, the securing mechanism or force retention device may include at least one spring, elastomeric band, or restoring device that may be connected between the main body and drop valve. In certain examples, the force retention device includes at least one spring. In one particular example, a spring may be positioned on each side of the main body and may be secured to a respective side of the drop valve (e.g., a first spring is positioned on a left side of the apparatus where one end of the spring is coupled to the left side surface of the main body and the other end is coupled to the left side surface of the drop valve and a second spring is positioned on a right side of the apparatus where one end of the spring is coupled to the right side surface of the main body and the other end is coupled to the right side surface of the drop valve). The at least one spring is configured to provide the securing force to hold the drop valve in a closed position, therein securing the bulk product within the dispensing apparatus (e.g., within the main body volume and the drop valve volume). Additionally, when an operator provides a dispensing force on the handle greater than and in an opposite direction from the securing force, the handle is moved downward to move the drop valve into a fully open or partially open position to dispense the bulk product from the drop valve volume and main body volume via gravity. When finished dispensing and upon release or reduction of the dispensing force on the drop valve, the securing force of at least one spring is configured to return the drop valve from the open position to the closed position.

The apparatus may include a membrane coupled to a lower surface of the front side surface of the main body. The membrane is configured to secure the opening of the drop valve when the drop valve is in the closed position. The membrane is further configured to provide a force against the drop valve as the drop valve is moved from the closed position to the open position such as to control the bulk product exiting the apparatus via gravity. For example, the membrane may be a rubber seal that assists in sealing the drop valve in the closed position.

The apparatus may include a relief wing or flow wing. The flow wing is configured to reduce or relieve at least a portion of the force of the product within the main body on the drop valve when the drop valve is in the closed position. For example, when the drop valve is closed, the force or weight of the product within the main body may cause the drop valve to open unintentionally or make it difficult for the drop valve to close properly. To prevent the drop valve from opening due to the force of the product in the main body on the drop valve, the relief wing is positioned to bear some of the force (i.e., weight) of the product, and as a result reduce the force on the drop valve. Such a flow wing is discussed in greater detail below.

The apparatus may further include a nozzle. The nozzle may be coupled or affixed to the front side surface of the main body such that when the drop valve is opened the bulk product is transferred from the drop vale and through the nozzle to exit the dispensing apparatus. In other words, the nozzle may be configured to receive the bulk product when the drop valve is in an at least partially open position, effectively regulating the flow rate of the bulk product as the bulk product exits the apparatus under the influence of gravity. This nozzle component and its interaction with the drop valve advantageously allows for precise dispensing, allowing for careful control of the product flow.

The nozzle and its connected façade component may also be configured to control the arcing movement of the drop valve and additionally restrict the range of motion of the drop valve as the drop valve pivots on the pivot point between the closed and open positions. This feature is advantageous for providing a controlled and predictable movement of the drop valve, thereby enhancing the precision and reliability of the product dispensing process.

Furthermore, the main body is configured to support a range of nozzle designs. The main body may be equipped with a nozzle specifically engineered for the dispensing of heavier products. Alternatively, it can also be equipped with a nozzle tailored for smaller and lighter products. This flexibility allows for precise product dispensing across a wide spectrum of product types and weights.

In another example, the apparatus includes a viewing window positioned on a front side surface of the façade and/or main body and configured to display the bulk product stored within the bulk product container inserted into the main body volume.

The viewing window advantageously enhances user experience and operational convenience. It allows users to visually inspect the quantity and condition of the bulk product without the need to open or disassemble the apparatus. This not only saves time but also minimizes the risk of potential disruptions to the dispensing process.

Additionally, the transparency of the viewing window ensures that users can quickly assess the need for replenishing the bulk product, thereby helping to maintain a continuous and efficient workflow. In summary, the inclusion of the viewing window in the apparatus is a thoughtful design element that promotes ease of use and operational efficiency, benefiting the user and the overall functionality of the apparatus.

Figure 11A:
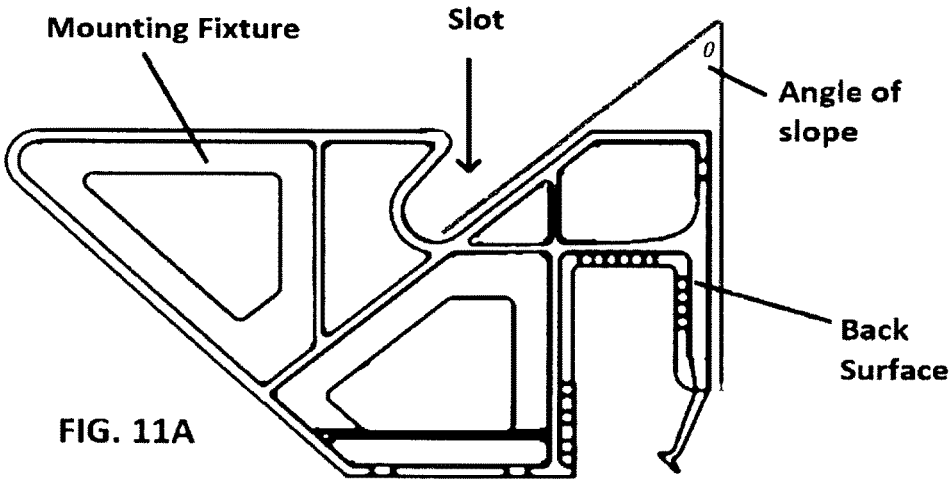
FIGS. 11A, 11B, and 11C depict views of examples of a mounting fixture of the dispensing apparatus and the fixture's interaction with the main body of the dispensing apparatus.
Figure 11B:
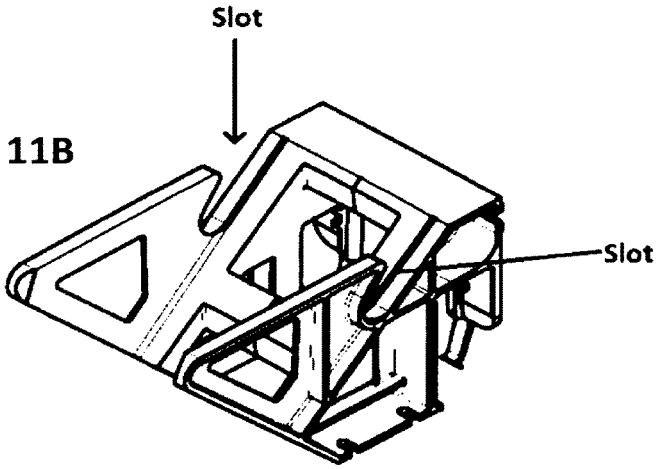
Figure 11C:
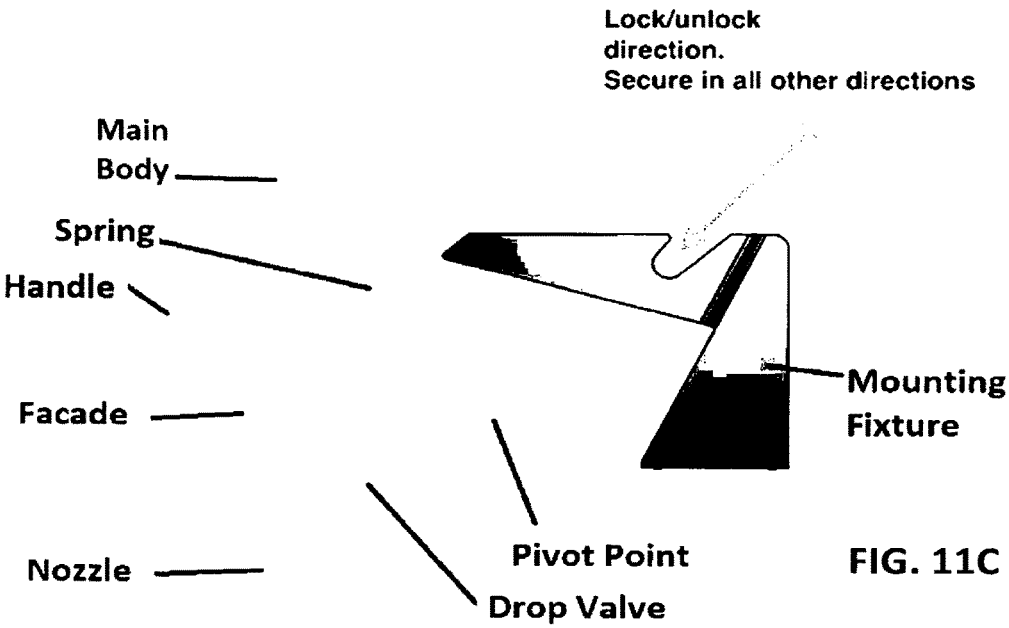

FIGS. 11A, 11B, and 11C depict different views of the mounting fixture of the dispensing apparatus/system. FIG. 11A depicts a side view of the mounting fixture. The mounting fixture has a back surface configured to be affixed or secured to any vertically oriented surface (e.g., wall). The mounting fixture additionally includes at least one slot or opening configured to receive a protrusion or fixture joint of the main body. In certain examples, as depicted in FIG. 11B, both sides of the mounting fixture contain a slot or opening configured to receive a respective protrusion or fixture joint of the main body.

As depicted in FIG. 11A, the slot of the mounting fixture is positioned such that the opening slopes downward and outward from the back surface of the mounting fixture. The angle of this slope, θ, as measured between the back surface of the mounting fixture and the bottom surface of the slot/opening may be in a range of 10° to 80°, in a range of 20° to 70°, in a range of 30° to 60°, in a range of 40° to 50°, or 45°.

As depicted in FIG. 11C, the angle of these openings or slots in the mounting fixture are advantageous in securing the main body in place for operation of the dispensing apparatus with little to no movement of the main body during operation (i.e., the downward force applied to the dispensing apparatus to dispense the bulk product does not affect any movement of the main body within the slot/opening of the mounting fixture). Simultaneously, this angle of the slots/openings additionally allows for quick removal of the main body from the mounting fixture by an operator to refill the main body/dispensing apparatus when needed.

Figure 12:
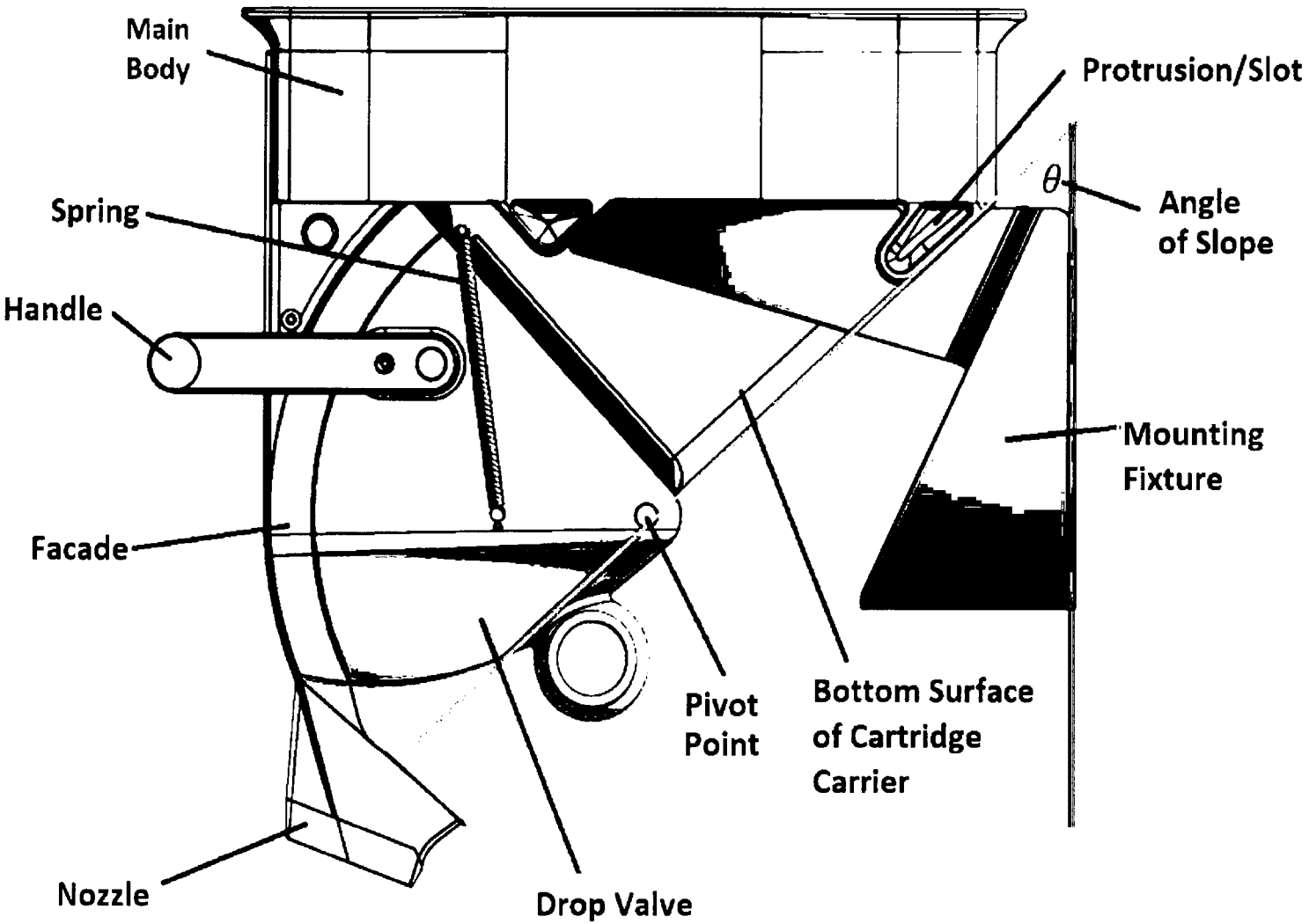
FIG. 12 depicts a side view of an example of a dispensing apparatus.

FIG. 12 depicts an additional side view of the example of the dispensing apparatus having a mounting fixture. As depicted in FIG. 12, the main body includes at least one angled protrusion or fixing mechanism configured to be secured within a respective slot or opening of the mounting fixture. The protrusion is not necessarily limited to shape depicted within the figure. Additionally, while FIG. 12 depicts only one protrusion and respective slot/opening, an additional, similarly shaped and angled protrusion or fixing mechanism may be positioned on the opposite side of the main body to be inserted into a respective slot/opening of the mounting fixture. In certain examples, the at least one protrusion is positioned on a side surface of the main body extending in an outward direction from the main body volume.

Additionally, as depicted in FIG. 12, each top edge of the four side surfaces of the main body may be flared out to assist in inserting the bulk product container into the main body volume.

In this example, the slots within the mounting structure are set at a 45° slope angle, similar to the example depicted in FIGS. 11A-11C. This slot is configured to be aligned with a similar angle (e.g., 45° angle) of the sloped protrusion or fixing mechanism. As noted above, the slope angles of the slots and respective protrusions are not limited to 45° but may be an angle in a range of 10° to 80°, in a range of 20° to 70°, in a range of 30° to 60°, or in a range of 40° to 50°.

As noted above, as the main body of the apparatus is configured to be secured onto the mounting fixture, the left and right side fixing mechanisms are inserted into their respective slots of the mounting structure, as depicted in FIG. 12. As a result, the movement of the apparatus is limited or avoided, thus advantageously securing or locking the apparatus into the mounting structure. In other words, when the drop valve is actuated (e.g., by a user), the apparatus is limited from displacing itself off the mounting structure. Additionally, when the dispensing process is completed and the chute is returned to its closed position, the upward movement of the drop valve does not adversely affect movement of the apparatus itself due to the fixing mechanisms. As such, movement is limited or avoided in both directions (i.e., moving the drop valve into an open position and returning the drop valve to the closed position).

Further, as depicted in FIG. 12, the main body may include at least one pivot point or hinge mechanism (e.g., one pivot point on each side surface of the main body) attached to the drop valve for assisting in the opening and closing of the drop valve via rotation about the pivot point/hinge. In certain examples, the pivot point may be positioned adjacent to a back side surface of the main body (i.e., adjacent to the mounting fixture), such that the bottom surface of the drop valve extends the entire length between the front and back sides of the main body, wherein the entire bottom surface is configured to move between the closed an open positions to dispense the bulk product. Alternatively, as depicted in FIG. 12 for example, the pivot point may be positioned at an intermediate location between a back side surface and a front side surface of the main body such that the bottom surface of the drop valve does not extend an entire length between the front side surface and the back side surface of the main body. In such an embodiment, the main body includes a bottom surface extending from the back side surface toward the pivot point location. As depicted in FIG. 12, this bottom surface of the main body may be positioned at an angle sloping downward from the back side surface toward the pivot point location. This may be advantageous in assisting with the transferring of the bulk product from the main body when the drop valve is moved into the open position (such that minimal bulk product remains trapped or unable to be transferred toward the drop valve).

In certain examples, the angle of slope of the bottom surface of the main body is at a same slope angle θ as the angle of the slots of the mounting fixture (as measured between the back surface of the mounting fixture or main body and the bottom surface of the main body). Such an angled configuration advantageously assists in securing the apparatus to the mounting fixture and providing equal load distribution.

Alternatively, the angle of the slope of the bottom surface of the main body may be at a different slope angle from the angle of the slots of the mounting fixture. In certain examples, the angle of the slope of the bottom surface of the main body may be in a range of 10° to 80°, in a range of 20° to 70°, in a range of 30° to 60°, in a range of 40° to 50°, or 45°.

Figure 13:
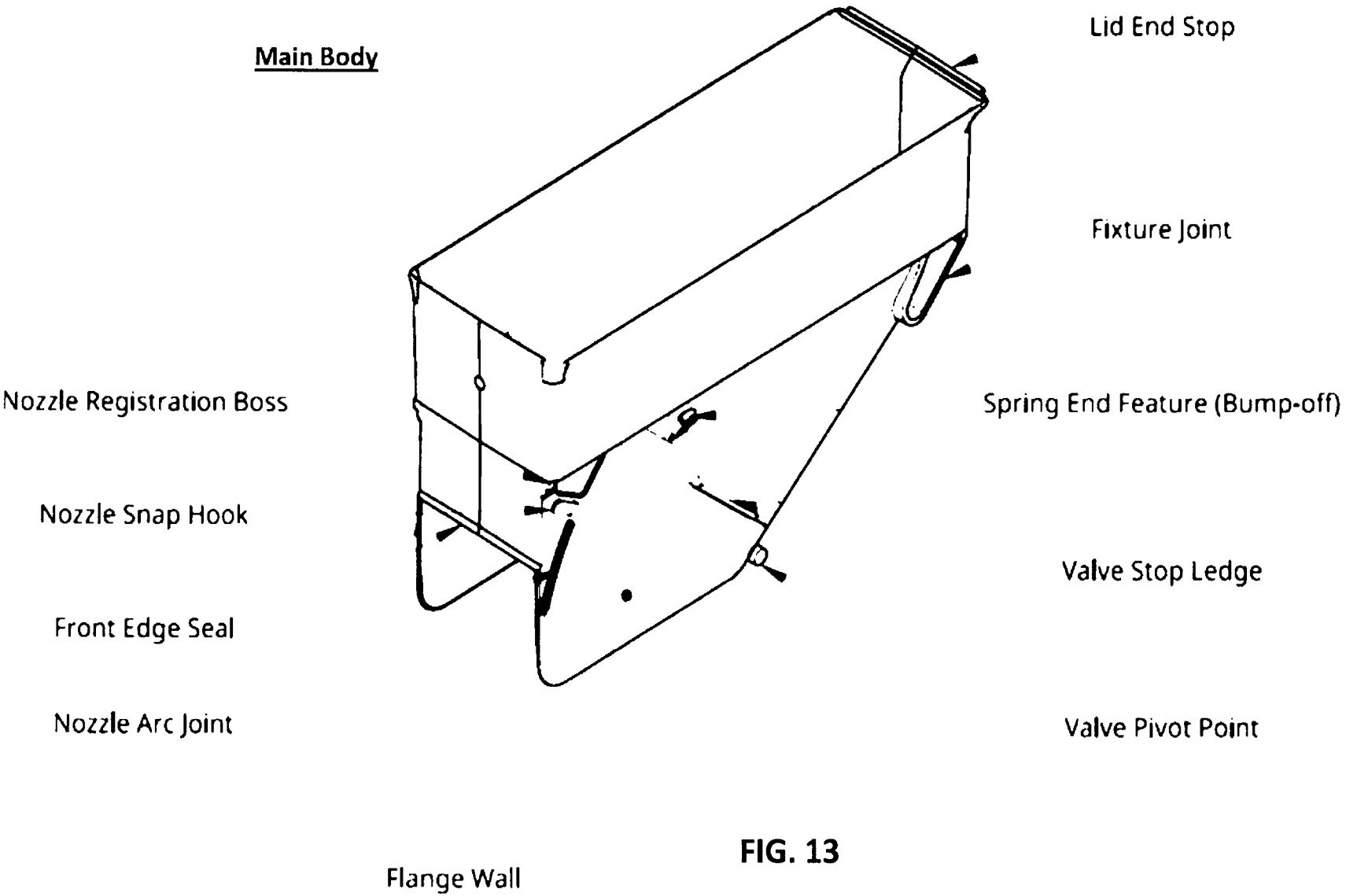
FIG. 13 depicts a perspective view of an example of the main body of a dispensing apparatus.

FIG. 13 depicts an additional prospective view of an example of a main body of the dispensing apparatus. As discussed above, the main body may include at least one fixture joint (e.g., on both sides of the main body) that is configured to be fixed and secured within a respective slot/opening of the mounting fixture. As noted above as well, the main body may further include at least one pivot point or hinge mechanism (e.g., one pivot point on each side surface of the main body) attached to the drop valve for assisting in the opening and closing of the drop valve via rotation about the pivot point/hinge.

The main body may further include at least one spring end feature (bump-off) configured to attach to a respective spring at one end, wherein the spring is connected at an opposite end to the drop valve. As noted above, the at least one spring is configured to provide a securing force to hold the drop valve in a closed position, therein securing the bulk product within the drop valve volume and main body volume of the dispensing apparatus. Additionally, when an operator provides a dispensing force on the handle greater than and in an opposite direction from the securing force, the handle is moved downward to move the drop valve into an open position to dispense the bulk product from the drop valve volume and main body volume via gravity. When finished dispensing, the at least one spring is configured to provide a restoring force to assist in returning the drop valve from the open position to the closed position upon release of the dispensing force on the drop valve.

The main body may further include a valve stop ledge configured to prevent movement of the drop valve toward the back end of the main body when the drop valve is in a closed position.

The main body may further include a flange wall on each side of the carrier that overlaps with the drop valve in a closed position and provides an interior surface to prevent bulk product from spilling out of the sides of the main body when the drop valve is in an open position.

The main body may further include a nozzle registration boss, a nozzle arc joint, and/or a nozzle snap hook on each side of the carrier that is configured to connect with and secure the nozzle of the dispensing apparatus to the front surface of the main body.

The main body may further include a front edge seal configured to prevent bulk product from spilling out of the front side of the main body when the drop valve is in a closed position.

The main body may further include a lid end stop on a back edge, and each top edge of the four side surfaces of the main body may be flared out to assist in inserting the bulk product container into the main body volume.

Figure 14:
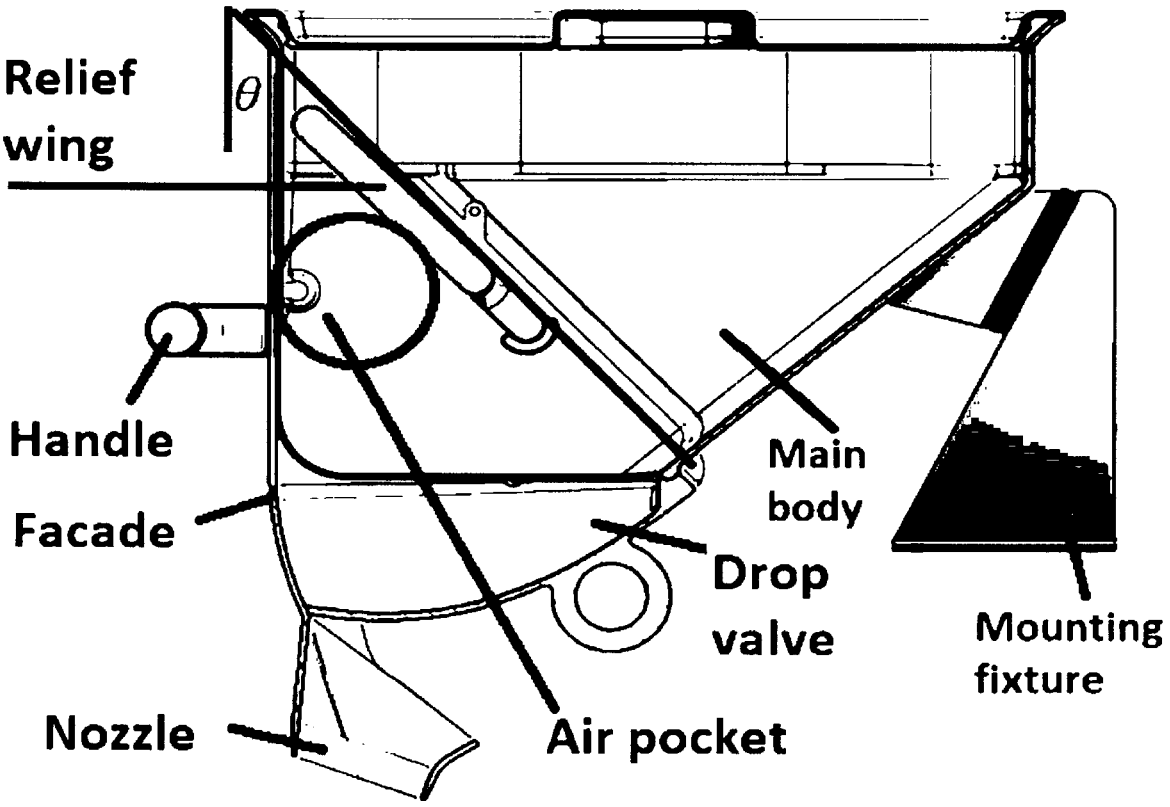
FIG. 14 depicts a cross-sectional view taken along lines A-A of the apparatus of the dispensing apparatus as depicted in FIG. 9.

FIG. 14 depicts a cross-sectional view taken along lines A-A of the apparatus as depicted in FIG. 9, therein depicting a relief wing or flow wing positioned within an inner area of the main body of the dispensing apparatus. As noted above, the relief wing is configured to reduce the force of the bulk item or product within the main body on the drop valve when the drop valve is in the closed position. For example, when the drop valve is closed, the force or weight of the product within the main body could cause the drop valve to open unintentionally or make it difficult for the drop valve to close properly. To prevent the drop valve from opening due to the force of the product in the main body on the drop valve, the relief wing may be positioned within an interior of the main body to absorb at least some of the force (i.e., weight) of the bulk product on the relief wing, and as a result reduce the force on the drop valve.

In other words, the utilization of the slope in the relief wing serves a dual purpose within the product dispensing system. Firstly, it plays a crucial role in minimizing the force exerted by the product held within the main body onto the drop valve. This reduction in force is advantageous as it helps maintain the integrity of the dispensing mechanism and ensures a controlled and gentle release of the product, reducing the risk of jams or damage.

Secondly, the slope of the relief wing also proves to be beneficial in enhancing the mixing or agitation of the product. This comes into play when the drop valve is open, as the sloped structure helps create a dynamic flow of the product. As a result, the product is not dispensed in a static or stagnant manner, but rather in a manner that encourages mixing, ensuring a more consistent and uniform output. In this way, the design of the relief wing goes beyond simply facilitating dispensing; it actively contributes to product quality and the overall efficiency of the dispensing process.

As depicted in FIG. 14, the relief wing is positioned inside of the main body. A first edge of the relief wing may be positioned adjacent to (e.g., abut) the front side surface of the main body. The second edge of the relief wing opposite from the first edge may be positioned adjacent to the bottom surface of the drop valve. The third and fourth edges of the relief wings are positioned adjacent to the side surfaces of the main body (i.e., adjacent to or abutting the flange walls of the main body as depicted in FIG. 13). The third and fourth edges may run perpendicular to the first and second edges of the relief wing. In certain examples, the relief wing may be formed at a slope extending a distance downward toward the drop valve such that the first edge is positioned higher than the second edge. This may be advantageous in both providing relief from the force of the bulk product on the drop valve, while also directing bulk product flow toward the bottom of the main body and agitating the flow of the bulk product (i.e., where it is not hung up on the top surface of the relief wing).

The angle of the slope of the relief wing, θ, as defined between defined between a plane running parallel to a floor and a plane of the relief wing, may be in a range of 10-80°, in a range of 20-70°, in a range of 30-60°, in a range of 40-50°, or 45°.

Figure 15A:
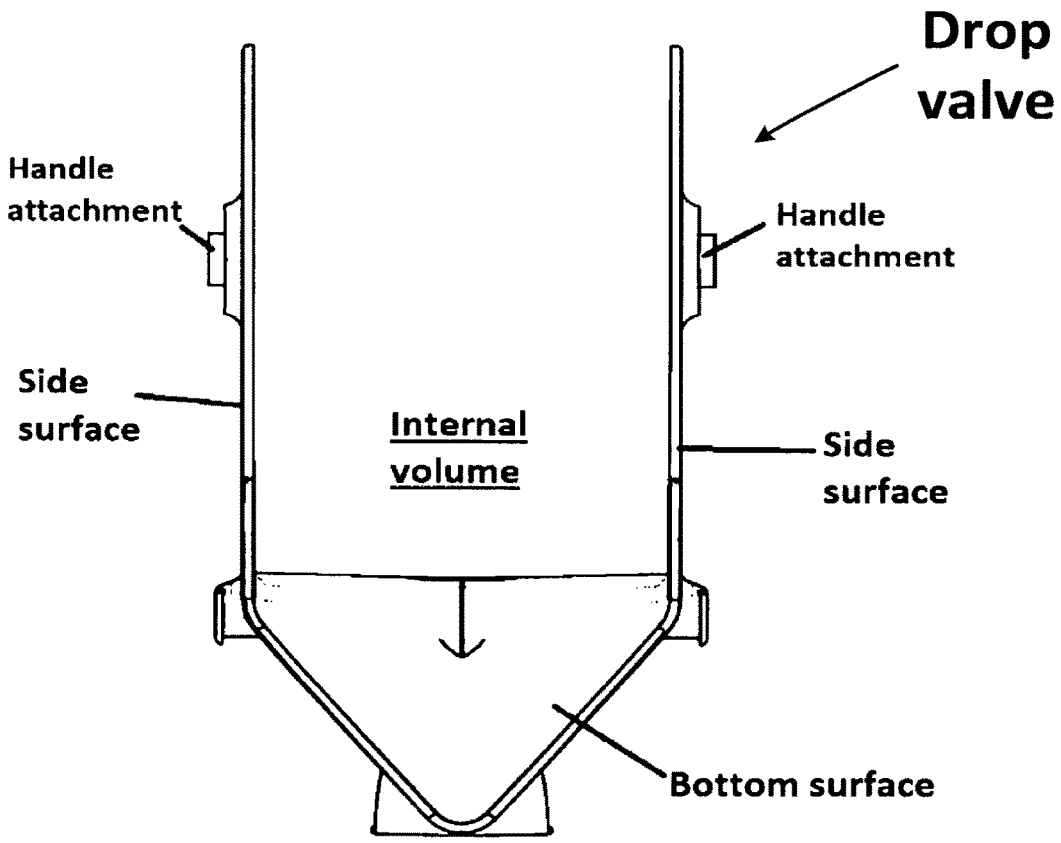
FIGS. 15A and 15B depict examples of a drop valve or dispensing chute of a storage system.
Figure 15B:
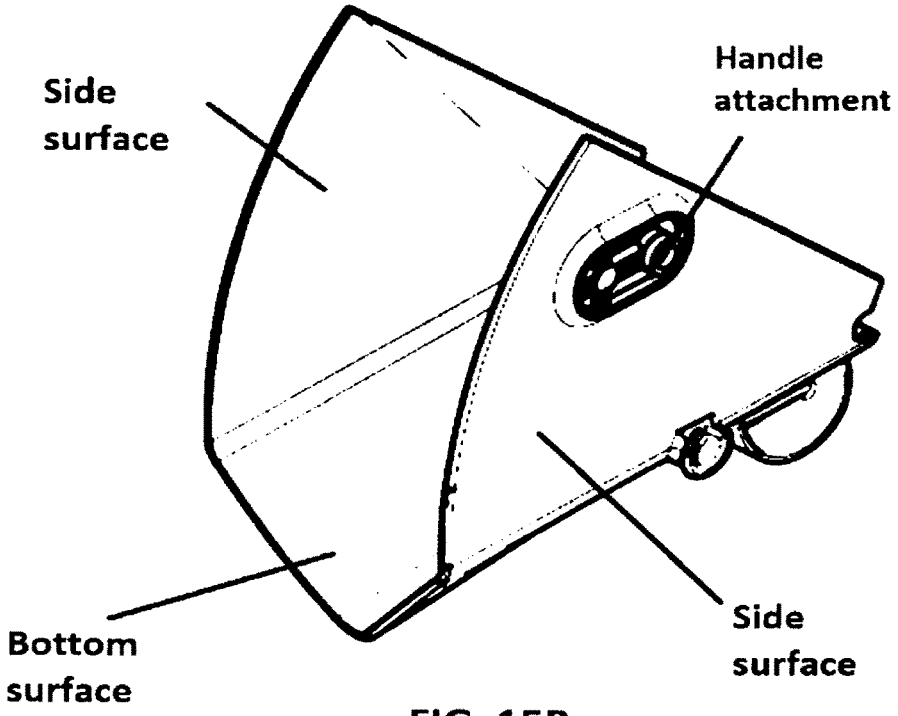

FIGS. 15A and 15B depict examples of the drop valve configured to be attached to and positioned below the main body. The drop valve may include a bottom surface and at least two side surfaces. The drop valve may be configured to move about a pivot point between a closed position and an open position via a dispensing force applied to the drop valve. When in the closed position, the two side surfaces and bottom surface form an internal volume having an open top. Additionally, when in a closed position, the drop valve is configured to secure the bulk product from the bulk product container positioned within the main body volume from exiting the apparatus. When in the open position, the drop valve is configured to provide an opening for the bulk product from the bulk product container positioned within the main body volume to exit the apparatus via gravity.

In certain examples, the pivot point or hinge may be positioned adjacent to a back side surface of the main body, such that the bottom surface of the drop valve extends the entire length between the front and back sides of the main body, wherein the entire bottom surface is configured to move between the closed an open positions to dispense the bulk product. Alternatively, as noted above and depicted in FIG. 12 for example, the pivot point or hinge may be positioned at an intermediate location between a back side surface and a front side surface of the main body such that the bottom surface of the drop valve does not extend an entire length between the front side surface and the back side surface of the main body. In such an embodiment, the main body includes a bottom surface extending from the back side surface toward the pivot point location. As noted above, and depicted in FIG. 12, this bottom surface of the main body may be positioned at an angle sloping downward from the back side surface toward the pivot point location to assist in transferring the bulk product from the main body when the drop valve is moved into the open position.

Returning to FIGS. 15A and 15B, the bottom surface of the drop valve may be positioned on an angle or slope extending a distance downward from the back side surface of the drop valve to a front side surface of the main body. The two side surfaces (i.e., left and right side surfaces) of the drop valve are connected to a respective edge of the bottom surface of the drop valve such as to form an internal volume. The internal volume is configured to transfer the bulk product from the bulk product container out of the apparatus adjacent to the front side surface of the main body when the drop valve is in the open position.

Furthermore, the bottom surface of the drop valve may be formed to have a "V" shape as can be seen in FIGS. 15A and 15B. However, the bottom surface of the drop valve may be formed to be any shape to assist in funneling (i.e., transferring) bulk product out of the bulk product container when the drop valve is open. In other words, the shape and slope of the bottom surface of the drop valve advantageously assists in the flow and controlled release of the bulk product.

Figure 16A:
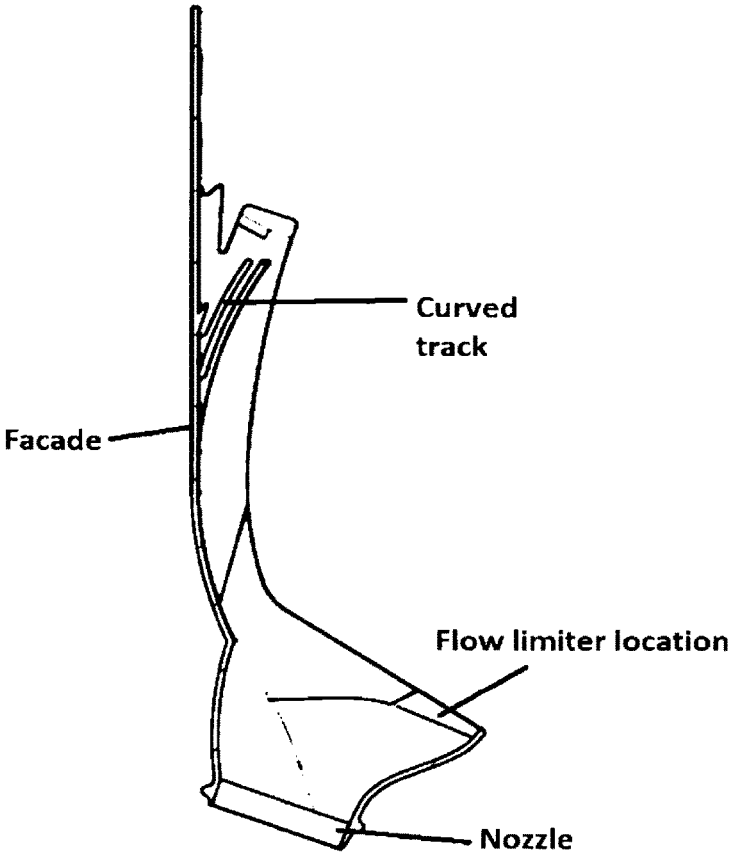
FIGS. 16A and 16B depict examples of a façade/nozzle of a dispensing apparatus.
Figure 16B:
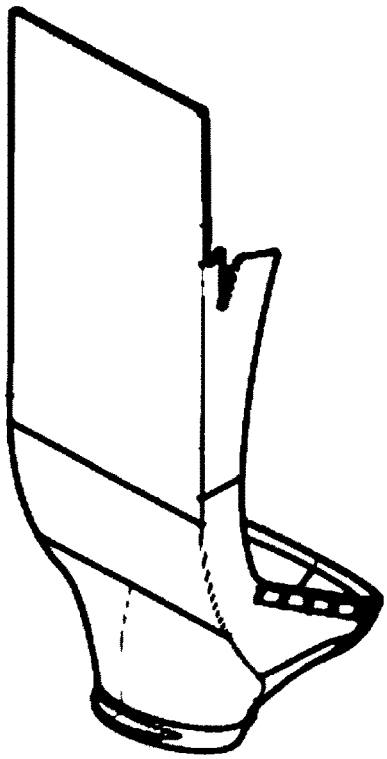

FIGS. 16A and 16B depict examples of a façade/nozzle component of a dispensing apparatus. As depicted in FIGS. 9, 10, and 12, for example, the façade/nozzle is coupled to the front side surface of the main body such that when the drop valve is opened the bulk product is transferred through a nozzle opening to exit the apparatus. In other words, the nozzle is configured to receive the bulk product when the drop valve is in the open position, effectively regulating the flow rate of the bulk product as it exits the apparatus under the influence of gravity based on the configuration (e.g., circumference of the nozzle opening). This advantageously allows for precise dispensing, allowing for careful control of the product flow.

The nozzle may also be configured to restrict the range of motion of the drop valve as it pivots on the pivot point/hinge between the closed and open positions. This feature is advantageous for providing the controlled and predictable movement of the drop valve, thereby enhancing the precision and reliability of the product dispensing process.

Furthermore, the dispensing apparatus is configured to support a range of nozzle designs and nozzle opening circumferences. The dispensing apparatus may be equipped with a nozzle specifically engineered for the dispensing of larger or heavier products. Alternatively, it can also be equipped with a nozzle tailored for smaller or lighter products. This flexibility allows for precise product dispensing across a wide spectrum of product types and weights. In certain examples, the façade/nozzle component may be configured to be removed and switched out with a differently shaped nozzle having a smaller or larger opening circumference based on the type (e.g., size/weight) of bulk product being dispensed.

In another example, the façade/nozzle component may have a viewing window positioned on a front side surface of the main body and configured to display the bulk product stored within the bulk product container inserted into the main body volume.

The viewing window may advantageously enhance the user experience and operational convenience. It allows users to visually inspect the quantity and condition of the bulk product without the need to open or disassemble the apparatus. This not only saves time but also minimizes the risk of potential disruptions to the dispensing process.

Additionally, the transparency of the viewing window provides that users may quickly assess the need for replenishing the bulk product, thereby helping to maintain a continuous and efficient workflow. In summary, the inclusion of the viewing window in the apparatus is a thoughtful design element that promotes ease of use and operational efficiency, benefiting the user and the overall functionality of the apparatus.

Figure 16C:
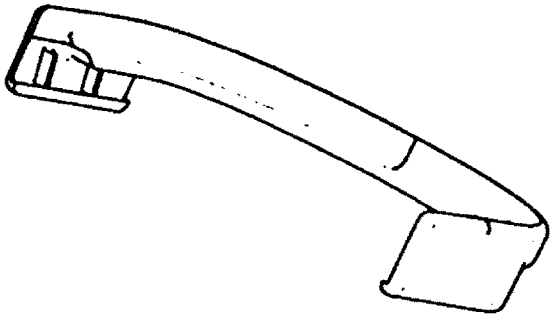
FIGS. 16C and 16D depict examples of a flow limiter configured to attach to the nozzle to restrict the movement of the drop valve and limit the flow of the bulk product from the drop valve through the nozzle opening.
Figure 16D:
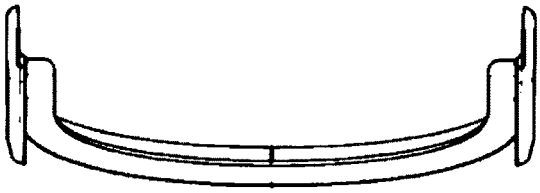

FIGS. 16C and 16D depict examples of a flow limiter configured to attach to the nozzle at an adjacent location to the drop valve to restrict the movement of the drop valve and limit the flow of the bulk product from the drop valve through the nozzle opening.

Figure 17A:
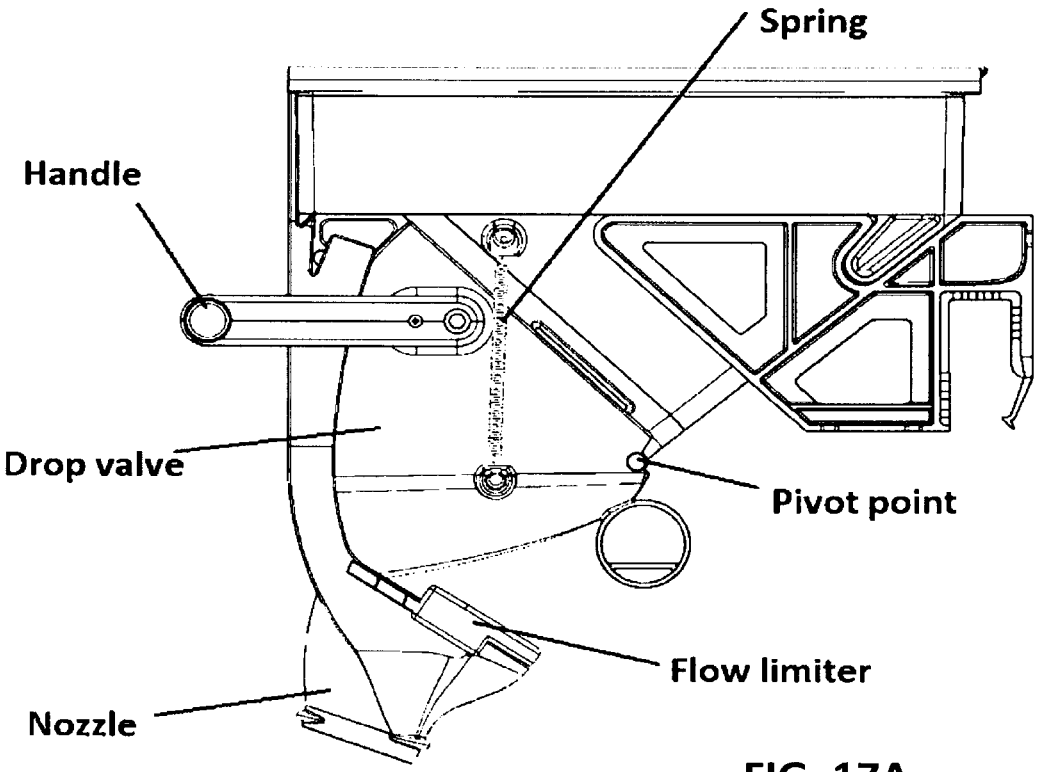
FIGS. 17A and 17B depict an example of a dispensing system moving between a closed position and an open position.
Figure 17B:
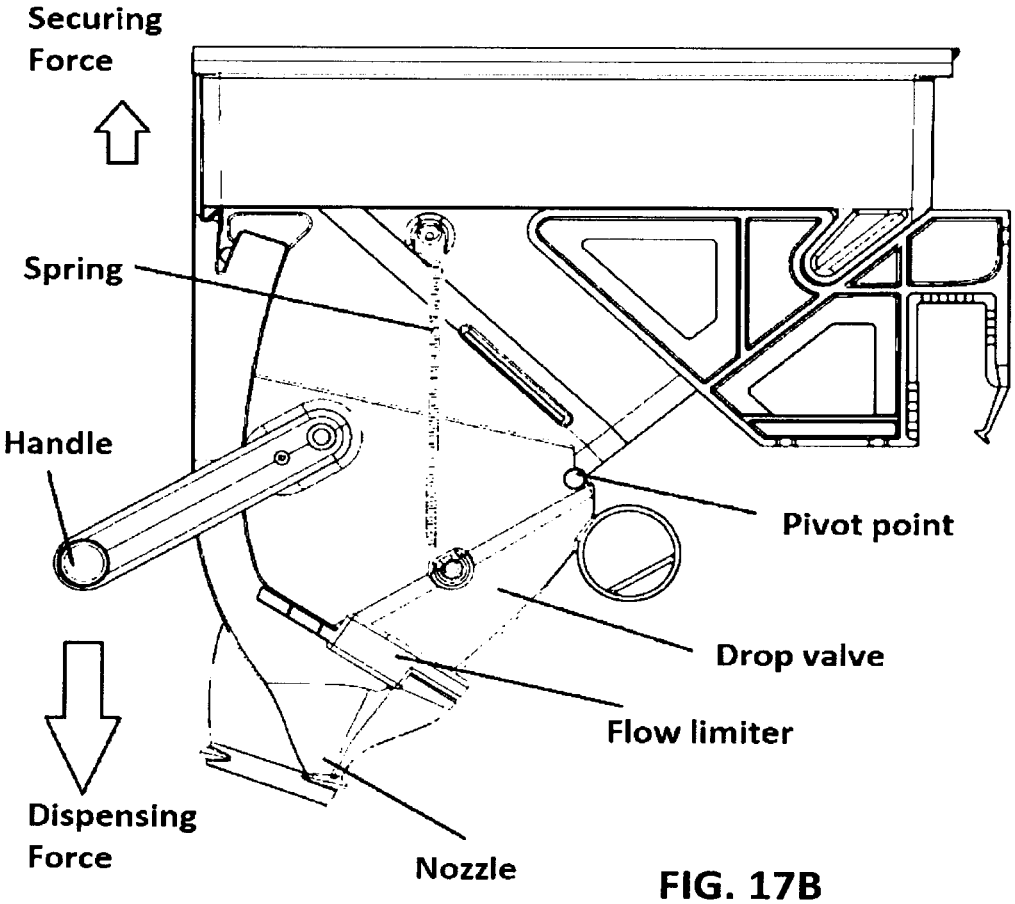

As depicted in the figures, the flow limiter may have a partial circle or a 'C' shaped configuration configured to slide over or otherwise attach to the nozzle (as depicted in greater detail in FIGS. 17A and 17B). As such, in addition to or alternatively from the nozzle configuration, the flow limiter may advantageously assist in restricting the range of motion of the drop valve as it pivots on the pivot point/hinge between the closed and open positions. Specifically, when attached to the nozzle, the flow limiter may restrict the range of motion of the drop valve, therein reducing or limiting the potential flowrate of the bulk product from the drop valve through the nozzle. This feature is advantageous for enhancing the precision and reliability of the product dispensing process. Additionally, the flow limiter may be advantageously added to the dispensing apparatus for bulk products that require a smaller drop valve opening to better control the flow rate of the bulk product. In one particular non-limiting example, the bulk product could be a food product or grain such as rice. Such an item could pour out of the drop valve through the nozzle at too fast a rate in a fully open position of the drop valve. As such, the addition of the flow limiter to the end of the nozzle could assist in restricting the movement of the drop valve to provide an effective rate of dispensing while preventing/limiting the chance for user error or over-dispensing of the bulk product.

FIGS. 17A and 17B depict an example of a dispensing system moving between a closed position and an open position. FIG. 17A depicts a side view of an example of a dispensing system in a closed position. In this example, the drop valve is shut and is kept in the shut or closed position by a securing force of the at least one spring. Additionally, in this particular example, a flow limiter is positioned on one end/opening of the nozzle, adjacent to the drop valve. As noted above, this component is advantageous in controlling or restricting how far the drop valve may open before bumping into an edge of the flow limiter. That is, without the flow limiter in place, the drop valve may be configured to open to a larger extent before being restricted or blocked by an edge of the nozzle.

FIG. 17B depicts a side view of the example of the dispensing system of FIG. 17A in an open position. In this example, the drop valve has been opened via application of a dispensing force in a downward direction on the handle that is greater than the securing force of the at least one spring. The drop valve has moved into the open position in which the bottom of the drop valve abuts an edge of the flow limiter.

Figure 18:
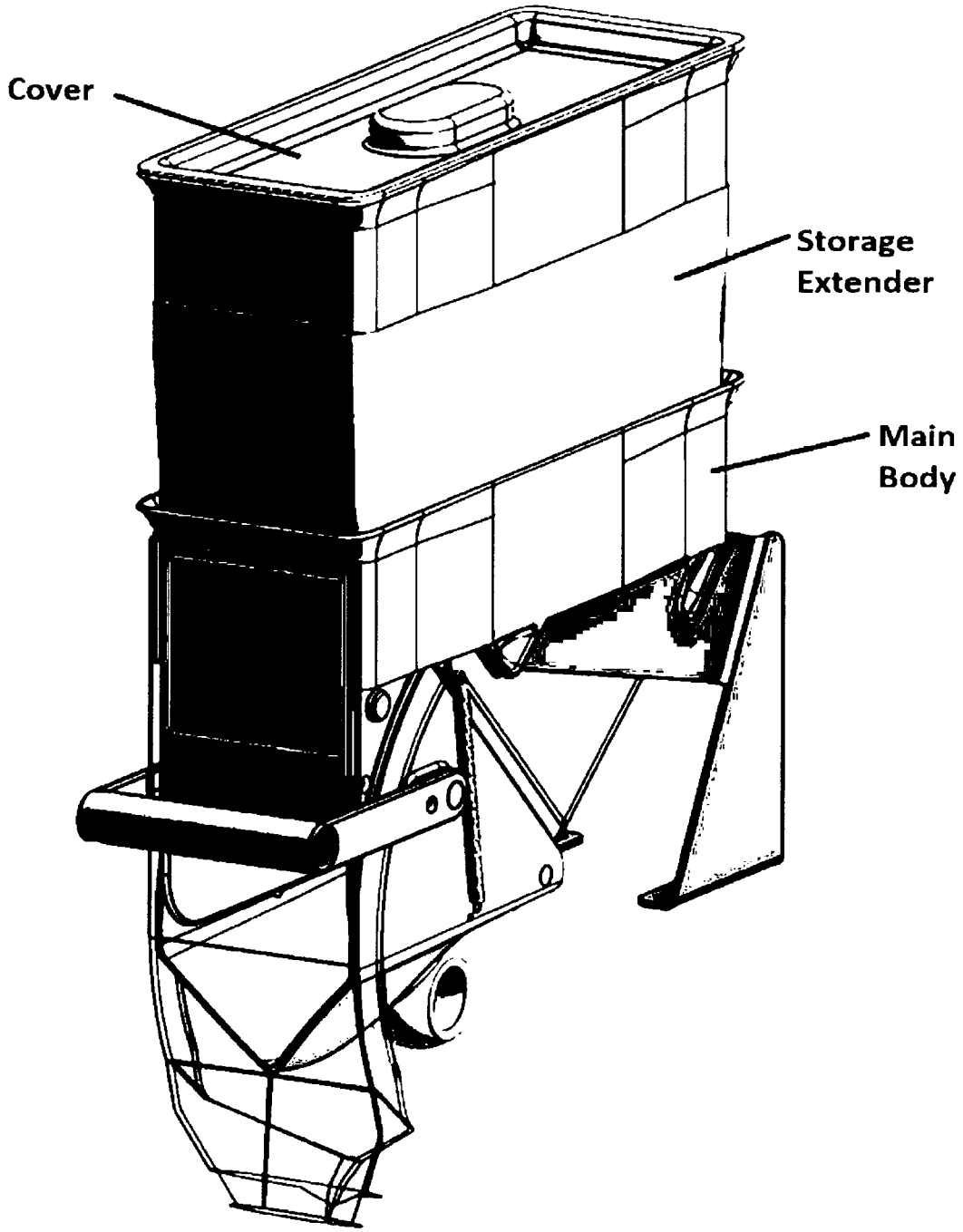
FIG. 18 depicts a perspective view of a dispensing apparatus including a storage extender.
Figure 19:
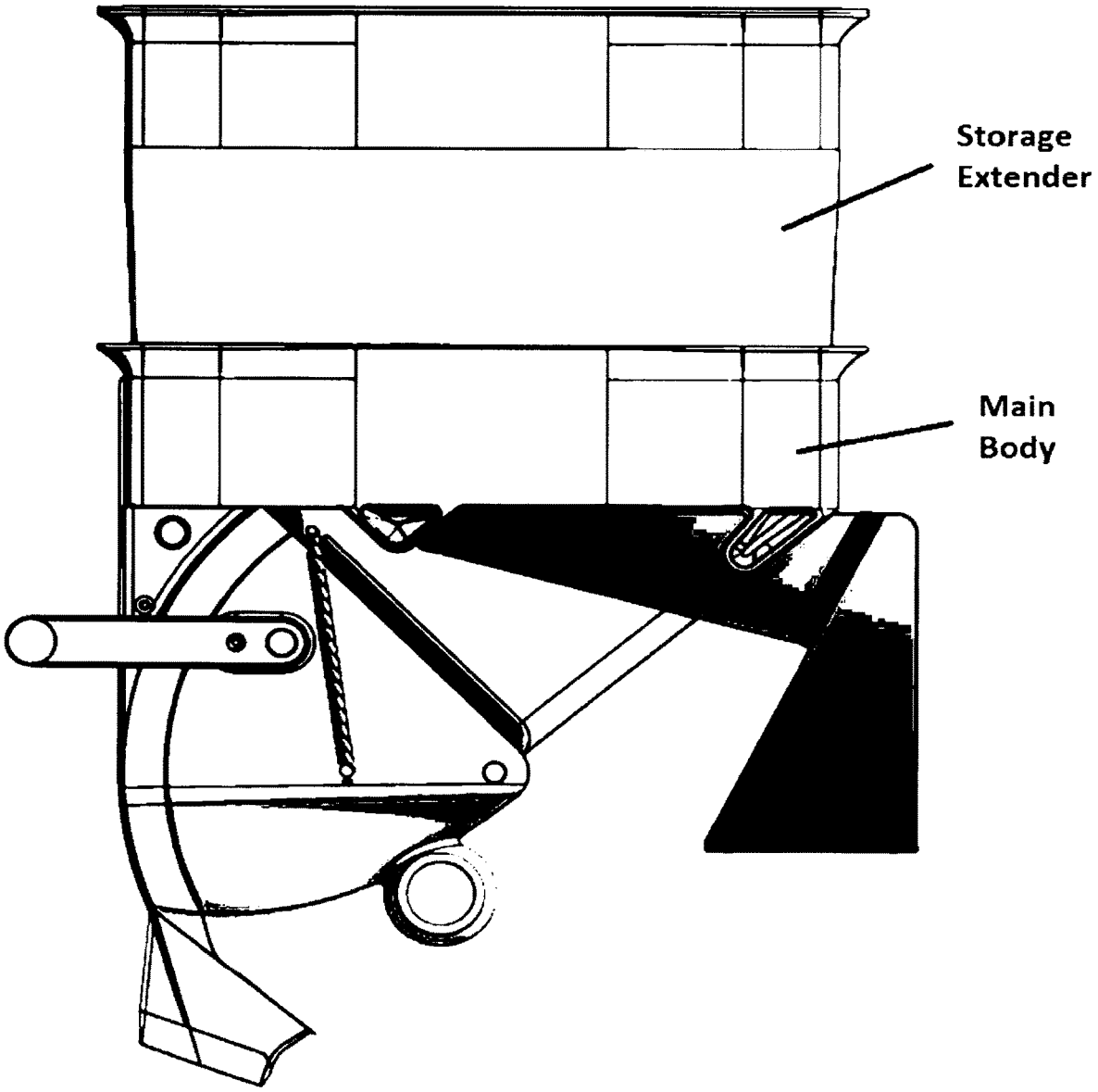
FIG. 19 depicts a side view of the dispensing apparatus including a storage extender.

FIGS. 18 and 19 depict another example of an apparatus/system that includes an extender. FIG. 18 depicts a perspective view of an apparatus/system including a storage extender. FIG. 19 depicts a side view of the apparatus/system including the storage extender.

The storage extender may be configured to be positioned above the main body to provide a storage location above the main body. The storage extender may include four side surfaces, an open top, and an open bottom that define an extender volume. A lid or cover may be configured to be positioned above the storage extender as well. The extender volume is configured to extend the main body volume such that bulk product may be configured to be stored within the extender volume or top loaded into the extender volume.

In other words, bulk product (e.g., bulk food) may be transferred from a container/bag into the storage extender and main body. The storage extender may be advantageous in providing a visible identification of the bulk product that may be concealed within dispensing apparatus. Additionally, the storage extender may advantageously provide extra storage volume to store the bulk products. This allows for easy removal and replacement of the bulk product container with little or no bulk product being wasted (e.g., the bulk product container can be completely emptied prior to replacement because a percentage of the bulk product originally stored in the bulk product container remains within the main body).

Additionally, in certain examples, the extender volume provides an alternative mechanism for adding/replenishing a diminished bulk product/bulk food item in the apparatus. Specifically, instead of removing the apparatus from the mounting fixture and positioning the apparatus over a bulk product container, the bulk product may be top loaded into the top opening of the extender (by pouring the bulk product from a cartridge or bag into the extender/main body directly, e.g., without removing the main body from the mounting fixture).

Figure 20:
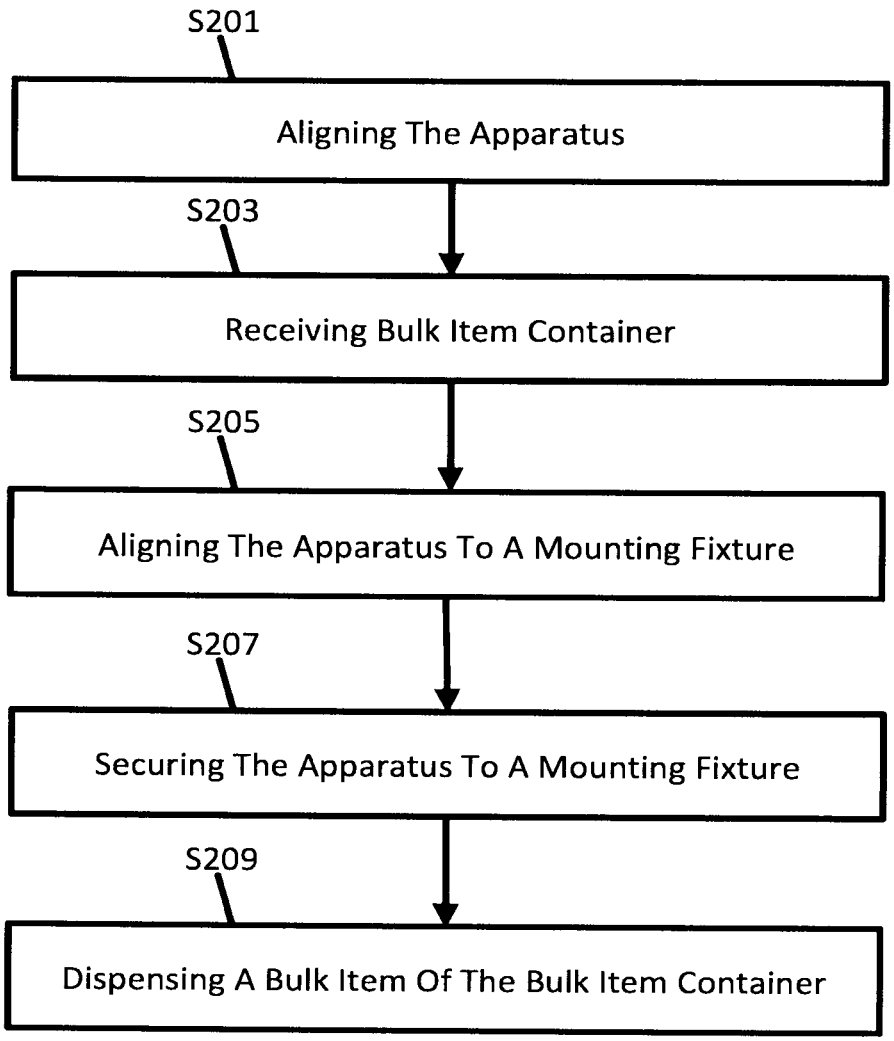
FIG. 20 illustrates a flow chart for an example of a method for receiving a bulk product container into a dispensing apparatus.

FIG. 20 illustrates a flow chart for a method for receiving a bulk product container into an apparatus or system depicted in FIG. 9. At act S201, the main body of the dispensing apparatus is aligned over an opening of the bulk product container. The bottom of the bulk product container is opened by removing any tape or adhesive keeping the flaps of the bottom of the bulk product container closed. The bulk product container is positioned such that the bottom is now facing upward so that none of the bulk product can fall out of the bulk product container when the adhesive is removed. The main body is inverted so that the open top of the main body is aligned above the bottom of the bulk product container. The bulk product container is received through the opening of the open top of the main body. The flared edges of the main body assist in having the bulk product container enter the main body smoothly.

At act S203, the bulk product container is received through the opening of the open top of the main body.

At act S205, the main body of the dispensing apparatus is flipped back over to an upright position with the bulk product container now positioned above the main body, and the main body/bulk product container are subsequently positioned and aligned over the mounting fixture.

In act S207, the main body is secured to the mounting fixture. The mounting fixture may be placed on a shelf, wall, or any vertical surface.

In act S209, a bulk product of the bulk product container is dispensed, by actuating the actuator or interface device (e.g., handle) in communication with the drop valve. As the interface device is actuated in a downward motion, the drop valve is moved about a pivot point into an open position. In the open position, the drop valve is configured to provide an opening for the bulk product from the bulk product container positioned within the main body volume and drop valve volume to exit the apparatus via gravity through the nozzle. Once finished, the actuator/interface device is actuated upward to close the drop valve and stop dispensing of the bulk product.

Figure 21:
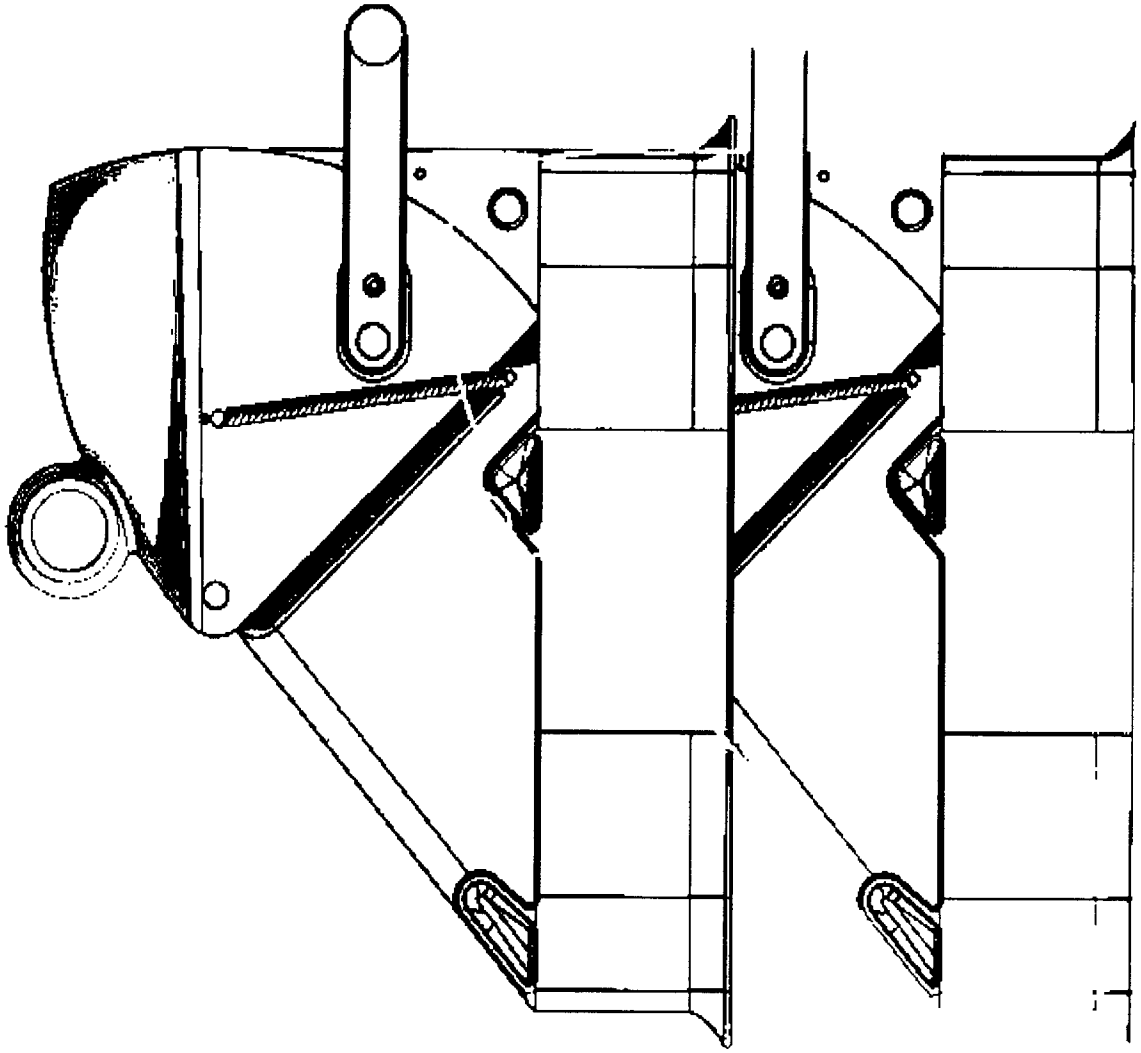
FIG. 21 depicts an example of a nesting arrangement for two dispensing apparatuses.

FIG. 21 depicts nesting of two of the apparatuses depicted in FIG. 9. As can be seen in FIG. 21, the configuration and shape of the dispensing apparatuses may advantageously be configured to be nested or stacked on top of one another for shipping efficiency.

Although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72 (b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the disclosure. The claims should not be read as limited to the described order or elements unless stated to that effect. Therefore, all embodiments that come within the scope and spirit of the following claims and equivalents thereto are claimed as the disclosure.

The invention claimed is:

1. A dispensing apparatus comprising:

a main body having four side surfaces, an open top, and an at least partially open bottom that provide a main body volume, wherein the main body is configured to receive a bulk product into the main body volume via the open top; and a drop valve positioned below and connected to the main body at a hinge, wherein the drop valve comprises a bottom surface and at least two side surfaces connected to a respective edge of the bottom surface to provide a drop valve volume, wherein the bottom surface comprises a front side adjacent to a front surface of the dispensing apparatus and a back side adjacent to the hinge, and wherein the drop valve is configured to move about the hinge between a closed position and an open position, wherein, in the closed position, the dispensing apparatus comprises a securing force configured to secure the bulk product positioned within the main body volume and the drop valve volume from exiting the dispensing apparatus, wherein, in the open position, the drop valve is configured to provide an opening for the bulk product positioned within the main body volume and the drop valve volume to exit the dispensing apparatus via gravity, wherein, the drop valve is configured to move about the hinge between the closed position and the open position via a dispensing force applied to the drop valve that is greater than the securing force, wherein, when moving between the closed position and the open position, the front side of the drop valve moves in a downward direction to provide the opening, while the back side of the drop valve remains in a same location adjacent to the hinge, and wherein the drop valve is configured to transfer the bulk product out of the dispensing apparatus adjacent to the front surface of the dispensing apparatus when in the open position.

2. The dispensing apparatus of claim 1, wherein the open top of the main body is configured to receive the bulk product via a bulk product storage container, cartridge, or bag.

3. The dispensing apparatus of claim 1, wherein the at least two side surfaces of the drop valve are configured to guide the bulk product and regulate flow of the bulk product out of the dispensing apparatus when the drop valve is in the open position.

4. The dispensing apparatus of claim 1, wherein the drop valve is configured for variable movement between the closed position and a fully open position, and wherein the open position refers to a partially open position between the closed position and the fully open position.

5. The dispensing apparatus of claim 1, further comprising:

an interface device in communication with the drop valve, wherein the interface device is configured to move the drop valve between the closed position and the open position upon application of the dispensing force to the interface device in the downward direction.

6. The dispensing apparatus of claim 1, further comprising:

at least one force retention device connected to the drop valve and the main body, wherein the at least one force retention device provides the securing force configured to secure the bulk product positioned within the main body volume and the drop valve volume from exiting the dispensing apparatus in the closed position and to return the drop valve from the open position to the closed position upon release of the dispensing force on the drop valve.

7. The dispensing apparatus of claim 6, wherein the at least one force retention device comprises a first retention device and a second retention device, wherein the first retention device connects a first side surface of the drop valve with a first side surface of the main body, and wherein the second retention device connects a second side surface of the drop valve with a second side surface of the main body.

8. The dispensing apparatus of claim 1, wherein, in the closed position, the bottom surface of the drop valve is positioned on a slope extending in a downward direction from a back side surface of the main body to the front surface of the dispensing apparatus.

9. The dispensing apparatus of claim 1, further comprising:

a flow wing positioned in the main body volume of the main body, wherein the flow wing is configured to reduce a force of the bulk product within the main body on the drop valve.

10. The dispensing apparatus of claim 9, wherein a first edge of the flow wing is positioned adjacent to a front side surface of the main body and the front surface of the dispensing apparatus, wherein a second edge of the flow wing opposite from the first edge is positioned adjacent to the bottom surface of the drop valve, wherein third and fourth edges of the flow wing are positioned adjacent to a left side surface and a right side surface of the main body, the third and fourth edges running perpendicular to the first and second edges of the flow wing, and wherein the flow wing is positioned at a slope extending in a downward direction toward the drop valve such that the first edge is positioned higher than the second edge.

11. The dispensing apparatus of claim 1, wherein the four side surfaces of the main body include flared edges at the open top, and wherein the flared edges are configured to assist in receiving a bulk product storage container or cartridge into the main body volume via the open top.

12. The dispensing apparatus of claim 1, further comprising:

a nozzle positioned below the drop valve, wherein the nozzle is configured to receive the bulk product when the drop valve is in the open position, wherein the nozzle is configured to limit a flow rate of the bulk product exiting the apparatus via gravity, and wherein the nozzle is configured to limit a range of movement of the drop valve between the closed position and the open position.

13. The dispensing apparatus of claim 12, further comprising:

a flow limiter attached to the nozzle, wherein the flow limiter is configured to further restrict the range of movement of the drop valve.

14. The dispensing apparatus of claim 1, further comprising:

a storage extender configured to be attached to the open top of the main body, wherein the storage extender comprises four side surfaces, an open top, and an open bottom that define a storage extender volume, and wherein the bulk product is configured to be stored within the storage extender volume or top loaded into the storage extender volume.

15. The dispensing apparatus of claim 1, wherein the hinge is positioned adjacent to a back side surface of the main body, the back side surface being opposite from a front side surface of the main body that is adjacent to an opening of the drop valve when the drop valve is in the open position.

16. The dispensing apparatus of claim 1, wherein the main body comprises a partial bottom surface connected to a back side surface and partially connected to a left side surface and a right side surface of the main body such that the at least partially open bottom of the main body extends between a front side surface of the main body and a front edge of the bottom surface, wherein the hinge is positioned in an intermediate location between the back side surface and the front side surface of the main body adjacent to the front edge of the bottom surface of the main body such that the bottom surface of the drop valve does not extend an entire length between the front side surface and the back side surface of the main body.

17. The dispensing apparatus of claim 16, wherein the partial bottom surface extends along a plane at a slope in a downward direction from the back side surface of the main body toward the front side surface of the main body, and wherein an angle of the slope as measured between the back side surface of the main body and the plane of the partial bottom surface is in a range of 10° to 80°.

18. The dispensing apparatus of claim 1, wherein the main body comprises at least one protrusion on a side surface of the main body extending in an outward direction from the main body volume, wherein the at least one protrusion is configured to be inserted into a slot of a mounting fixture secured to a vertical surface to secure the dispensing apparatus to the vertical surface via the mounting fixture, and wherein the at least one protrusion and a respective slot of the mounting fixture are positioned at an angle extending downward and outward from a back surface of the mounting fixture.

19. The dispensing apparatus of claim 1, further comprising:

a mounting fixture configured to be secured to a vertical surface, wherein the mounting fixture comprises at least one slot configured to hold a portion of the main body of the dispensing apparatus to secure the main body of the dispensing apparatus to the vertical surface as well.

20. The dispensing apparatus of claim 19, wherein the main body comprises at least one protrusion on a side surface of the main body extending in an outward direction from the main body volume, wherein the at least one protrusion is configured to be inserted into the slot of the mounting fixture, and wherein the at least one protrusion and a respective slot of the mounting fixture are positioned at an angle extending downward and outward from a back surface of the mounting fixture.

21. The dispensing apparatus of claim 9, wherein the flow wing is positioned above the drop valve in the main body volume.

* * * * *